US006334487B1

(12) United States Patent
Adkins et al.

(10) Patent No.: US 6,334,487 B1
(45) **Date of Patent: *Jan. 1, 2002**

(54) VALVE ASSEMBLY

(76) Inventors: Courtney W. Adkins, 18578 N. Oxford, Katy, TX (US) 77449; Thurman B. Caarter, 2901 Roseheath, Houston, TX (US) 77073; John D. Roberts, 16423 Fox Crossing La., Spring, TX (US) 77379; William A. Blizzard, Jr., 4314 Island Hills Dr., Houston, TX (US) 77059; Richard M. Ward, 16015 Creighton Rd., Conroe, TX (US) 77302

( * ) Notice: Subject to any disclaimer, the term of this patent is extended or adjusted under 35 U.S.C. 154(b) by 0 days.

This patent is subject to a terminal disclaimer.

(21) Appl. No.: 09/552,533

(22) Filed: Apr. 19, 2000

Related U.S. Application Data

(60) Division of application No. 08/845,996, filed on Apr. 25, 1997, now Pat. No. 6,116,336, which is a continuation-in-part of application No. 08/715,573, filed on Sep. 18, 1996, now Pat. No. 5,743,331.

(51) Int. Cl.[7] ..... E21B 29/00
(52) U.S. Cl. ..... 166/55.7; 166/117.6; 166/334.4
(58) Field of Search ..... 166/55.7, 117.6, 166/334.4, 334.3, 321, 319, 213, 212, 206, 240

(56) References Cited

U.S. PATENT DOCUMENTS 5,743,331 A * 4/1998 Adkins et al. ..... 166/55.7
6,116,336 A * 9/2000 Adkins et al. ..... 166/55.7

* cited by examiner

*Primary Examiner*—William Neuder
(74) *Attorney, Agent, or Firm*—Fulbright & Jaworski L.L.P.

(57) ABSTRACT

A milling system has been invented for milling an opening in a tubular in a tubular string in a wellbore extending down from a surface of the earth, the milling system, in one aspect, has a whipstock connected to an anchor assembly and a mill apparatus releasably connected to the whipstock, the mill apparatus having auto fill apparatus therein. A mill has been invented with a mill body with a top end and a bottom end, a flow bore through the mill body, and an auto fill apparatus in the flow bore. A valve assembly has been invented for selectively controlling fluid flow through a hollow tubular in a string of hollow tubulars in a wellbore extending from a surface of the earth into the earth, the valve assembly in one aspect having positions limited to at rest, circulate, and anchor set positions so that a fluid pressure indicating at the surface indicates only either a pressured up position for anchor setting or a pressured up position for fluid circulation. A milling system has been invented with apparatus for releasably containing an isolated charge of fluid. A float valve for use in wellbore operations has been invented with a valve member having a vent hole for releasing fluid pressure build up beneath the valve member. A fill sub has been invented which uses such a float valve.

32 Claims, 20 Drawing Sheets

576
504
502
503
507
501
506
507
511
510
508
581
580
509
582
507
506
550
507
509
505
549
521
575
563
574
561
520
547
560
548
573
541
545
562
544
540
543
523
522
546
532
532
530
542
572
533
571
531

POSITION 1.

Fill ports open

POSITION 2.

Circulate ports open

POSITION 3.

All ports closed

POSITION 4.

Setting ports open

POSITION 5.

All valve ports closed

Mill ports open

POSITION 6.

Circulate ports open

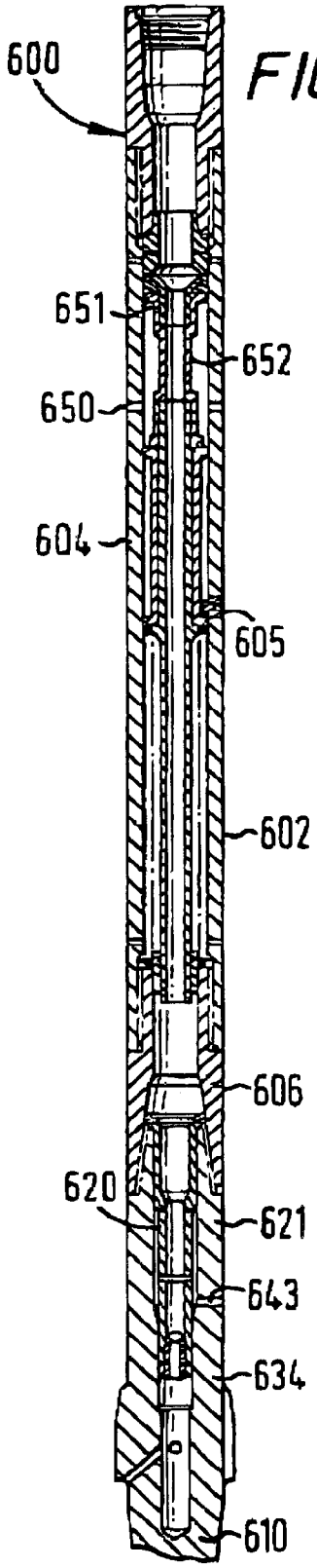
FIG. 6A
FIG. 6B
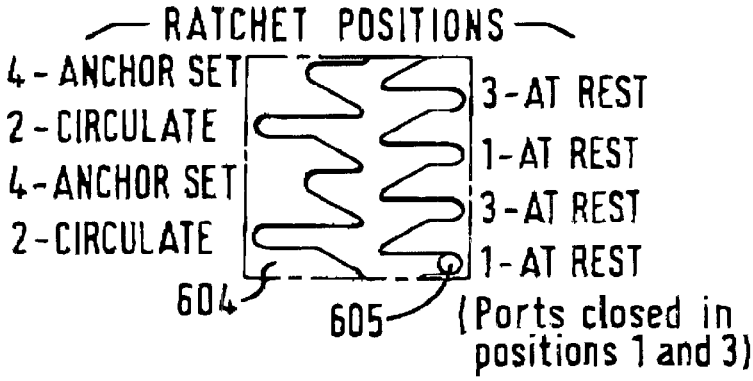
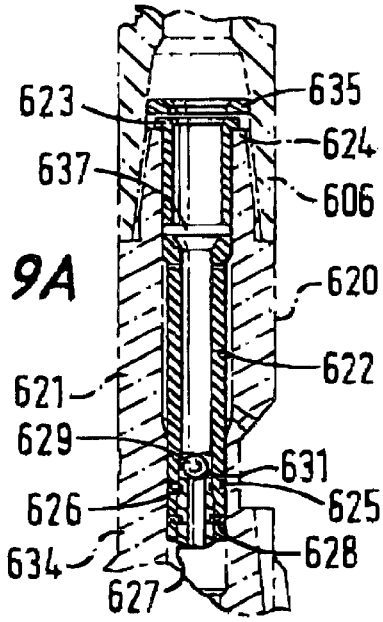
FIG. 9A
FIG. 9B
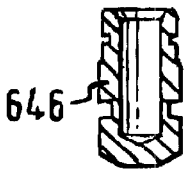
FIG. 9C
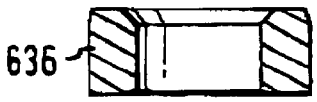

POSITION 1 - AT REST
(Ports closed)

POSITION 2-CIRCULATE
(Ports open)

POSITION 3 - AT REST
(Ports closed)

POSITION 4 - ANCHOR SET
(Ports closed)

VALVE ASSEMBLY

RELATED APPLICATIONS

This is a division of U.S. Ser. No. 08/845,996 filed Apr. 25, 1997 now U.S. Pat. No. 6,116,336 which is a continuation-in-part of U.S. Ser. No. 08/715,573 filed Sep. 18, 1996 now U.S. Pat. No. 5,743,331 entitled "Wellbore Milling System" both co-owned with the present invention and incorporated fully herein for all purposes.

BACKGROUND OF THE INVENTION

1. Field of the Invention

This invention is related to wellbore milling processes; milling tools and whipstocks and anchors for them; and in one aspect to single-trip milling methods and systems.

2. Description of Related Art

Milling tools are used to cut out windows or pockets from a tubular, e.g. for directional drilling and sidetracking; and to remove materials downhole in a well bore, such as pipe, casing, casing liners, tubing, or jammed tools. Various prior art tools have cutting blades or surfaces and are lowered into the well or casing and then rotated in a cutting operation. With certain tools, a suitable drilling fluid is pumped down a central bore of a tool for discharge beneath the cutting blades to assist in the removal from the well of cuttings or chips.

Milling tools have been used for removing a section of existing casing from a well bore to permit a sidetracking operation in directional drilling, to provide a perforated production zone at a desired level, to provide cement bonding between a small diameter casing and the adjacent formation, or to remove a loose joint of surface pipe. Also, milling tools are used for milling or reaming collapsed casing, for removing burrs or other imperfections from windows in the casing system, for placing whipstocks in directional drilling, or for aiding in correcting dented areas of casing or the like. Prior art sidetracking methods use cutting tools of the type having cutting blades and use a deflector such as a whipstock to cause the tool to be moved laterally while it is being moved downwardly in the well during rotation of the tool, to cut an elongated opening pocket or window in the well casing.

Certain prior art operations which employ a whipstock also employ a variety of tools used in a certain sequence. That requires a plurality of "trips" into the wellbore. For example, a false base (e.g. a plug, bridge plug, packer or anchor packer) is set in a casing or in a borehole that serves as a base on which a whipstock can be set. Certain prior art whipstocks have a movable plunger which acts against such a false base. In certain multi-trip operations, a packer is oriented and set in a wellbore at a desired location. This packer acts as an anchor on or against which tools above it may be urged to activate different tool functions. The packer typically has a key or other orientation indicating member. The packer's orientation is checked by running a tool such as a gyroscope indicator into the wellbore. In this case a whipstock-mill combination tool is then run into the wellbore by first properly orienting a stinger at the bottom of the tool with respect to a concave face of the tool's whipstock or by using an MWD tool. Splined connections between a stinger and the tool body facilitate correct stinger orientation. A starting mill is secured at the top of the whipstock, e.g. with a setting stud and nut. The tool is then lowered into the wellbore so that the packer engages the stinger and the tool is oriented. Slips extend from the anchor and engage the side of the wellbore to prevent movement of the tool in the wellbore. Pulling or pushing on the tool then shears the setting stud, freeing the starting mill from the tool. Rotation of the string with the starting mill rotates the mill. The starting mill has a tapered portion which is slowly lowered to contact a pilot lug on the concave face of the whipstock. This forces the starting mill into the casing to mill off the pilot lug and cut an initial window in the casing. The starting mill is then removed from the wellbore. A window mill, e.g. on a flexible joint of drill pipe, is lowered into the wellbore and rotated to mill down from the initial window formed by the starting mill. Typically then a window mill with a watermelon mill mills all the way down the concave face of the whipstock forming a desired cut-out window in the casing. This may take multiple trips. Then, the used window mill is removed and a new window mill and string mill and a watermelon mill are run into the wellbore with a drill collar (for rigidity) on top of the watermelon mill to lengthen and straighten out the window and smooth out the window-casing-open-hole transition area. The tool is then removed from the wellbore. The prior art also discloses a variety of single-trip milling systems each of which requires that a packer, bridge plug, anchor packer, or other securement be provided as a base in a tubular upon which to position the milling.

The prior art also discloses a variety of single trip setting systems for whipstocks, usually hydraulically actuated, each of which allows circulation usually only once at setting depth, after which time pins are usually sheared and any additional pumping will only pressurize the system to actuate hydraulic setting devices.

There has long been a need for an efficient and effective single trip whipstock setting method that allows for selective pressurization or circulation while fluid is being pumped through the drillstring, and also selectively provides or prevents communication between the inside and outside of the drillstring while no fluid is being pumped through the drillstring. There has long been a need for systems effecting such a method, as well as tools useful in such a method.

There has long been a need for an efficient and effective single-trip milling method and systems for effecting the method. There has long been a need for tools useful in such a method. There has long been a need for such systems which do not require a base upon which the system is emplaced and/or which have a selectively settable anchor apparatus which does not require the dropping of a ball, dart, etc.

SUMMARY OF THE PRESENT INVENTION

The present invention, in one embodiment, discloses a system for selectively anchoring a wellbore tool at a desired location in a wellbore or tubular member such as casing or tubing. In one aspect the system has a selectively settable anchor assembly that has a piston that is moved upwardly by fluid under pressure from the surface. The piston moves apparatus that pushes one or more movable slips out from a body of the anchor assembly to set the anchor assembly in place.

In one aspect the system as described above has a whipstock connected to the anchor assembly. Fluid under pressure flows to the anchor assembly through the whipstock and/or through tubing on the exterior of the whipstock. In one aspect the whipstock is selectively releasably connected to the anchor assembly. In one aspect a mill (or mills) is releasably connected to the whipstock. In one aspect, fluid under pressure flows through the mill(s) to the whipstock (e.g. but not limited to through a channel in a mill, through a shear stud, through a pilot lug on the mill, and through a channel through the mill intercommunicating with the anchor assembly) or fluid under pressure flows through the mill, through exterior tubing to the whipstock, and through the whipstock to the anchor assembly.

In one aspect a selectively actuable valve assembly is provided according to the present invention for selectively controlling the flow of fluid under pressure from an inlet end of the valve assembly out through an outlet end thereof. In one aspect such a valve assembly has a rotatable ratchet sleeve which (in being moved upwardly or downwardly by members responding to increased or decreased fluid pressure) rotates to selectively maintain the valve assembly in a plurality of positions so that fluid under pressure either flows through selected ports to selected flow lines or does not flow at all. In one aspect such a valve assembly is used with a system as previously described to selectively provide actuating fluid under pressure to an anchor assembly as described to set the movable slip(s) thereof and, in one aspect, to then provide jetting fluid to jetting ports of the mill(s).

The present invention teaches, in certain embodiments, a system as described herein wherein the valve assembly of the system provides selective circulation or pressurization while a pump at the surface is engaged, the pump providing fluid under pressure to the valve assembly; such a system that provides fluid communication between the inside and the outside of the drillstring while the pumps are not pumping fluid under pressure; such a system wherein the system may be run in the hole on a drillstring so that the drill string fills up with fluid from outside the system that flows into the system to the interior of the drillstring through the system, e.g., to inhibit buoyancy of the drillstring in the hole; such a system which does not require that anything be dropped down thereinto in order to actuate parts of the system or provide for flow of fluid under pressure to and through selected desired conduits and channels; a valve assembly as shown or described herein and such a valve assembly with mill(s) releasably attached thereto, directly or indirectly, the valve assembly in fluid communication with the mill(s); such a valve assembly with a whipstock interconnected therewith, directly or indirectly, and in fluid communication therewith; such a valve assembly interconnected with, directly or indirectly, an anchor assembly as shown or described herein, the valve assembly in fluid communication with the anchor assembly; and an anchor assembly as shown or described herein with a mill and/or whipstock and/or valve assembly as shown or described herein interconnected therewith and in fluid communication therewith.

The present invention, in certain embodiments, discloses a milling system for milling an opening in a tubular in a tubular string in a wellbore extending down from a surface of the earth, the milling system having an anchor assembly to set the milling system in the tubular, a whipstock connected to the anchor assembly, a mill apparatus releasably connected to the whipstock, the mill apparatus having auto fill apparatus therein that opens when the milling system is introduced into the wellbore to permit fluid in the wellbore to enter through the mill into the tubular string, and a valve assembly connected at a top end thereof to the tubular string and at a bottom end thereof to the mill apparatus for selectively controlling fluid flow from the surface to the anchor assembly; such a system with a lug/ratchet slot system having the plurality of position recesses including recesses corresponding to an at rest position of the system in which the at least one first valve flow port and the at least one piston flow port are aligned so that as the system is run into the wellbore fluid in the wellbore is permitted to fill the system, a circulate position of the system wherein the at least one piston flow port is aligned with the at least one second valve flow port so that fluid in the piston pumped down from the surface is flowable out from the hollow body, and a set anchor position of the system in which the at least one piston flow port is aligned with the top end of the body channel so that fluid pumped from the surface is flowable past the ratchet sleeve in a channel within the hollow body and out from the hollow body to the anchor assembly to set the anchor assembly; such a system wherein the valve assembly has a plurality of recesses consisting of four recesses in sequence, a first at rest recess corresponding to a first at rest position and mode of operation, a circulate recess corresponding to a circulation position and mode of operation, a second at rest recess corresponding to a second at rest position and mode of operation, and an anchor set recess corresponding to an anchor setting position and mode of operation; such a milling system wherein a fluid pressure level within the milling system indicates that the milling system is in either a pressured up status for anchor setting or at a pressure level for fluid circulation so that inadvertent anchor setting is avoided; and such a milling system with the auto fill apparatus further having the mill apparatus having a flow bore therethrough, a ball seat releasably secured in the flow bore of the mill apparatus by a shearable member. The present invention, in certain embodiments, discloses a mill with a mill body with a top end and a bottom end, a flow bore through the mill body, at least one port in fluid communication with the flow bore and through which fluid is flowable from within the mill to an exterior thereof and from the exterior thereof to within the mill, and auto fill apparatus in the flow bore above the at least one port. The present invention, in certain embodiments, discloses a valve assembly for selectively controlling fluid flow through a hollow tubular in a string of hollow tubulars in a wellbore extending from a surface of the earth into the earth, the valve assembly with a hollow body with a hollow piston mounted for reciprocal up and down rotative movement therein, the hollow body having an inwardly projecting lug, the hollow piston having at least one piston fluid flow port therethrough and the hollow body having at least two body fluid flow ports therethrough, a ratchet sleeve connected to the piston, the ratchet sleeve having a branched slot therearound which is movable on the lug so that the ratchet sleeve and the piston are movable to a plurality of positions, the branched slot with a plurality of position recesses, at least one position in which fluid is flowable from within the hollow body to an exterior thereof and at least one position in which fluid is flowable from outside the hollow body thereinto, the positions limited to at rest, circulate, and anchor set positions so that a fluid pressure indication at the surface indicates only either a pressured up position for anchor setting or a pressured up position for fluid circulation. The present invention, in certain embodiments, discloses a milling system with a mill having a top and a bottom and mill flow bore therethrough extending down from the top thereof, a sub with a top and a bottom and a sub bore therethrough connected at the top of the mill and in fluid communication therewith, a valve in the sub bore permitting fluid flow down through the sub and preventing fluid flow up through the sub, an exit hole in the mill body in fluid communication with the mill flow bore, a rupture disc closing off the mill flow bore and disposed beneath the exit hole so that a charge of fluid is disposable between the valve and the rupture disc; and such a mill system wherein the charge of fluid is clean fluid and the milling system has a wellbore device connected to the mill and in fluid communication with the exit hole so that the charge of clean fluid is movable down to the wellbore device to activate the wellbore device. The present invention, in certain embodiments, discloses a float valve for use in wellbore operations, the float valve with a body with a top and a bottom and a fluid flow bore therethrough, a valve seat on the body, a valve member movably secured to the body for movement to seat against the valve seat to close off flow through the float valve and for movement away from the valve seat to permit fluid flow through the float valve, and a vent hole through the valve member for releasing fluid pressure build up beneath the valve member. The present invention, in certain embodiments, discloses a fill sub with a hollow body with a top, a bottom, a flow bore therethrough from top to bottom, and a fill port through the body permitting fluid communication from an exterior of the body into the flow bore, a fill valve assembly in the hollow body, the fill valve assembly having a first bore and a second bore, the first bore in fluid communication with the fill port and having a ball seat, a ball movably mounted in the first bore, an urging member mounted in the first bore in contact with the ball and releasably urging the ball against the ball seat, the ball movable away from the ball seat in response to fluid entering through the fill port and overcoming force of the urging member so that fluid from the exterior of the fill sub may enter and pass through the fill sub, the second bore in fluid communication with the flow bore so that fluid is flowable from the top of the body, through the flow bore, through the second bore, back into and through the flow bore and out from the bottom of the body, a float valve disposed in the flow bore below the fill valve assembly; such a fill sub wherein the float valve has a body with a top and a bottom and a fluid flow bore therethrough, a valve seat on the body, a valve member movably secured to the body for movement to seat against the valve seat to close off flow through the float valve and for movement away from the valve seat to permit fluid flow through the float valve, and a vent hole through the valve member for releasing fluid pressure build up beneath the valve member.

It is, therefore, an object of at least certain preferred embodiments of the present invention to provide:

New, useful, unique, efficient, non-obvious selectively actuable wellbore anchoring apparatus; such apparatus in combination with a whipstock; such apparatus and whipstock in combination with one or more mills; valve assemblies for selectively applying fluid under pressure to such apparatus; and milling systems and methods for single-trip milling operations;

A milling system and a mill with an auto fill apparatus;

A float valve with a vented valve member;

A device for releasably containing a charge of fluid for activating a wellbore apparatus;

A milling method in which a window is milled at a desired location in a tubular; and A system for such a method.

This invention resides not in any particular individual feature disclosed herein, but in combinations of them and it is distinguished from the prior art in these combinations with their structures and functions. There has thus been outlined, rather broadly, features of the invention in order that the detailed descriptions thereof that follow may be better understood, and in order that the present contributions to the arts may be better appreciated. There are, of course, additional features of the invention that will be described hereinafter and which may be included in the subject matter of the claims appended hereto. Those skilled in the art who have the benefit of this invention will appreciate that the conceptions, upon which this disclosure is based, may readily be utilized as a basis for the designing of other structures, methods and systems for carrying out the purposes of the present invention. It is important, therefore, that the claims be regarded as including any legally equivalent constructions insofar as they do not depart from the spirit and scope of the present invention.

The present invention recognizes and addresses the previously-mentioned problems and needs and provides a solution to those problems and a satisfactory meeting of those needs in its various possible embodiments and equivalents thereof. To one of skill in this art who has the benefits of this invention's realizations, teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention as broadly as legally possible no matter how others may later disguise it by variations in form or additions of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by references to certain embodiments thereof which are illustrated in the appended drawings, which drawings form a part of this specification. It is to be noted, however, that the appended drawings illustrate certain preferred embodiments of the invention and are therefore not to be considered limiting of its scope, for the invention may admit to other equally effective or equivalent embodiments.

FIG. 6A is a side cross-section view of a value assembly and mill (partial) according to the present invention.

FIG. 6B shows lug positions for the valve assembly of FIG. 6A.

FIG. 9A is an enlarged side cross-section view if a setting device of the mill of FIG. 8.

FIG. 9B shows a plug of the device of FIG. 9A.

FIG. 9C is a side cross-section view of an alternative keeper for use with the device of FIG. 9A.

DESCRIPTION OF EMBODIMENTS PREFERRED AT THE TIME OF FILING FOR THIS PATENT

Figure 1:
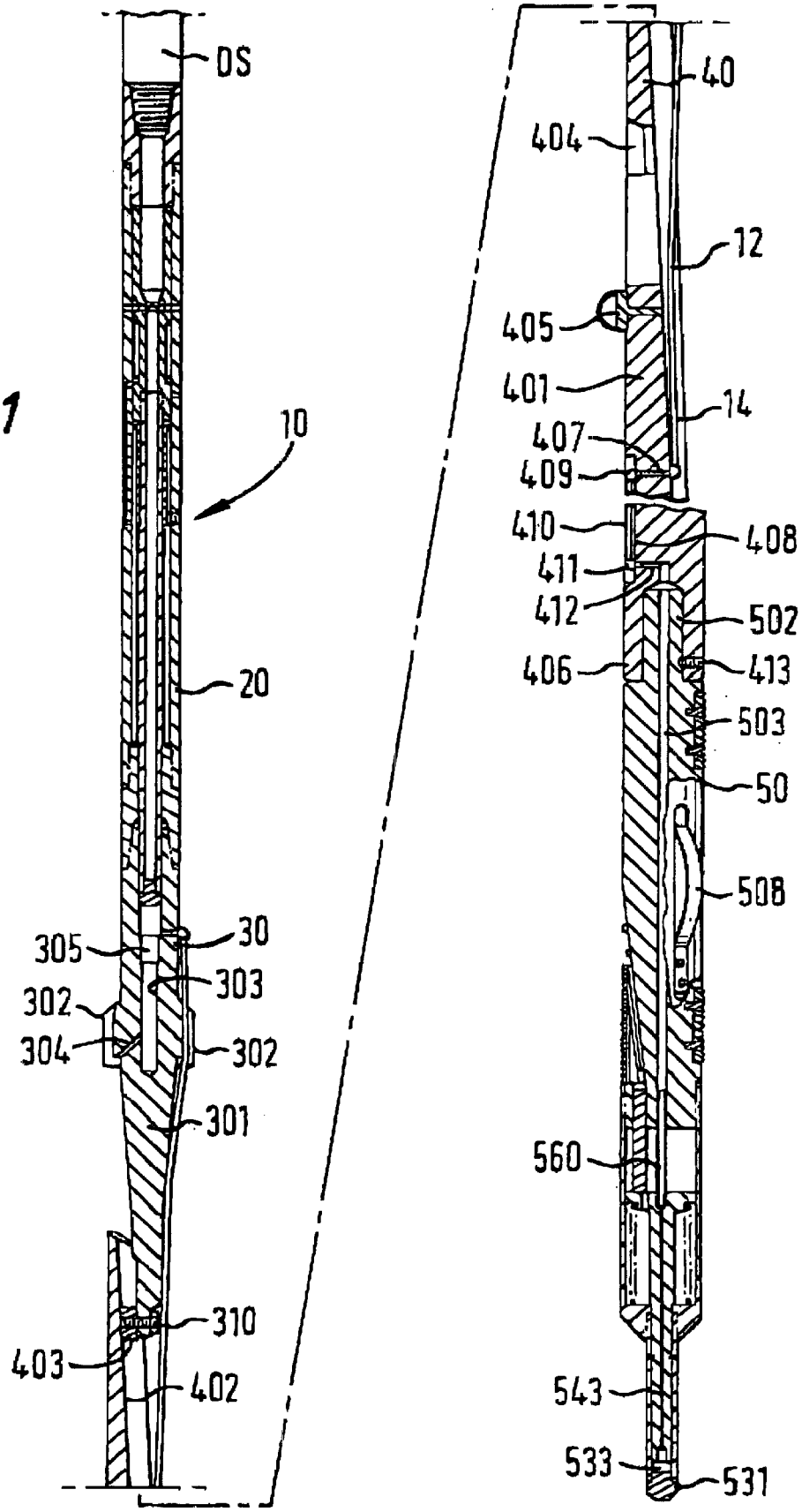
FIG. 1 is a side view in cross-section of a system according to the present invention.

FIG. 1 shows a system 10 according to the present invention with a valve assembly 20, a mill 30, a whipstock 40 and an anchor assembly 50 interconnected with a tubular string, e.g. but not limited to coil tubing or a drill string DS. Tubing 12 conducts fluid under pressure selectively introduced from the surface and through the valve assembly 20 from the mill 30 to the whipstock 40 from which it flows to selectively activate the anchor assembly 50. The system 10 may be run into a hole and/or tubular member string (e.g. a cased hole) and the whipstock may be oriented using known MWD (measurement-while-drilling) devices, gyroscopic orienting apparatus, etc.

Figure 2A:
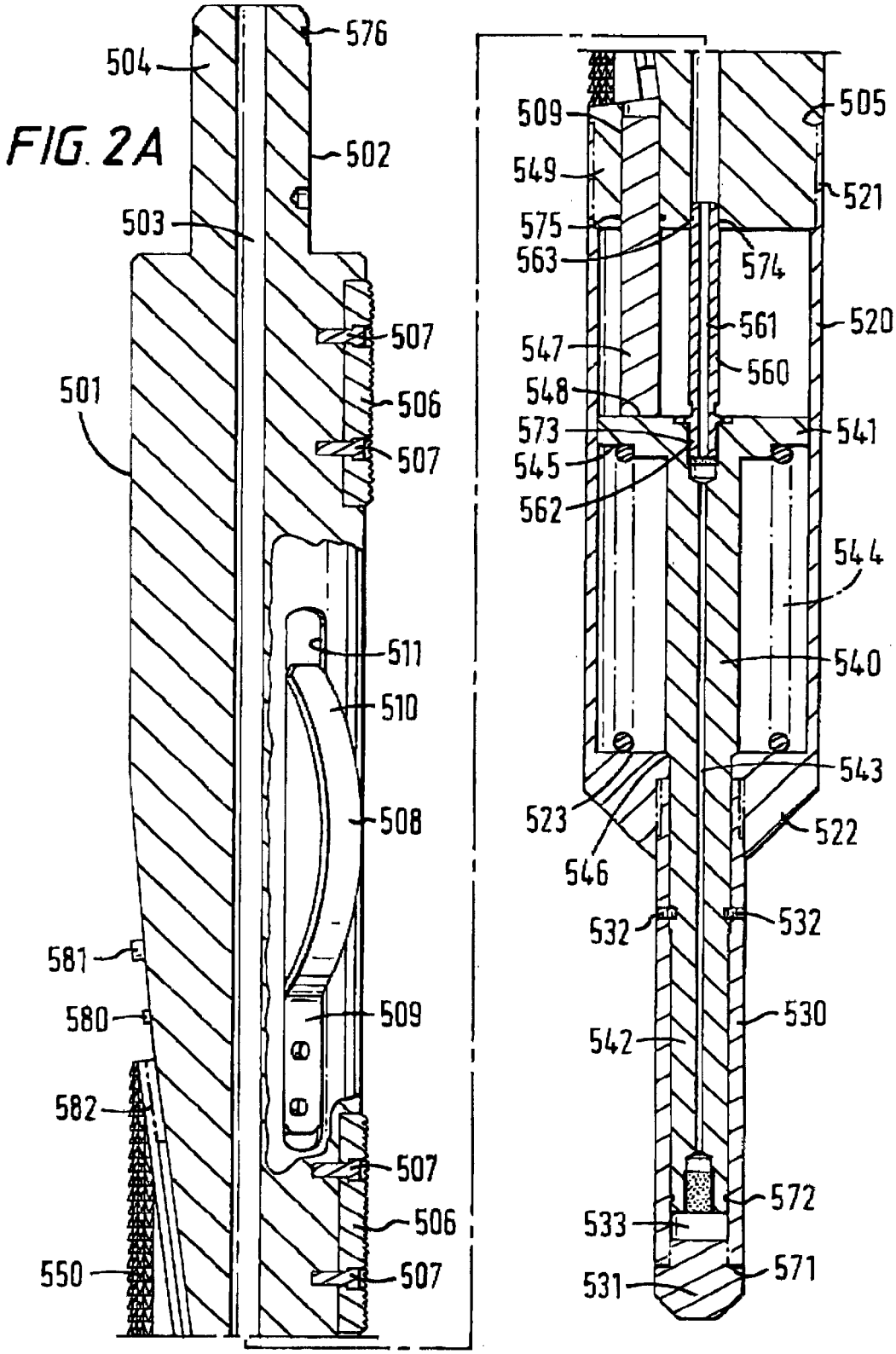
FIG. 2A is a side view in cross-section of the anchor assembly of the system of FIG. 1.
Figure 2B:
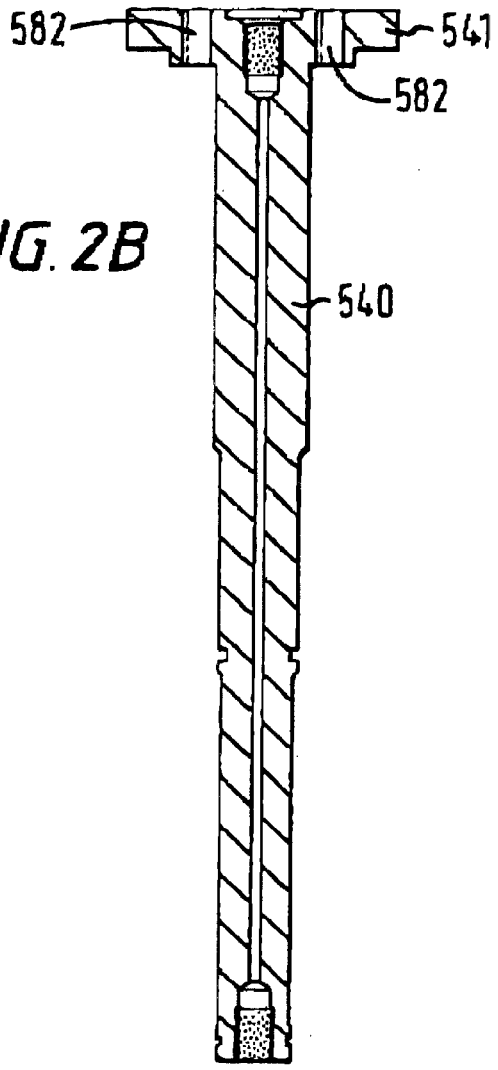
FIG. 2B is a side view in cross-section of the piston assembly of the anchor assembly of FIG. 2A.
Figure 4:
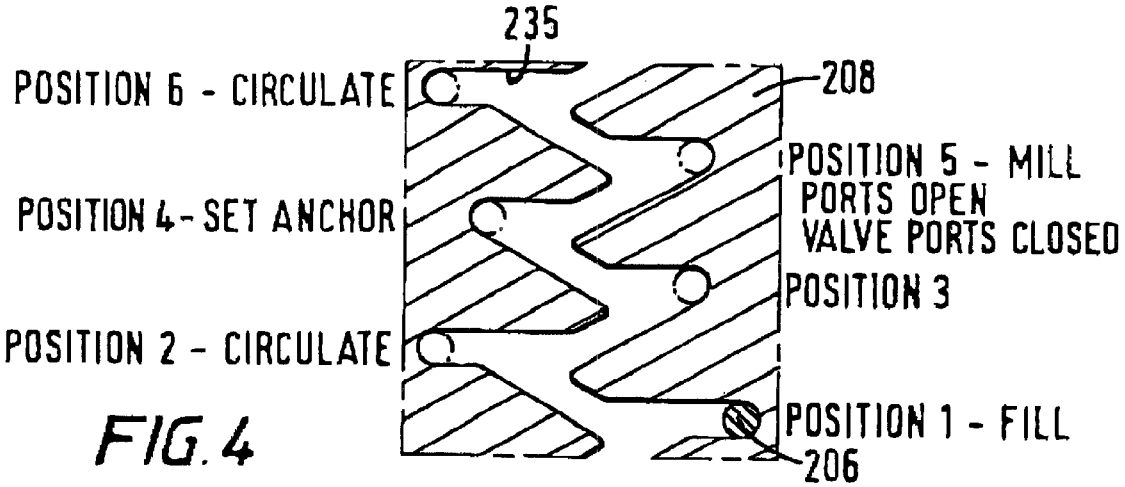
FIG. 4 shows part of a ratchet sleeve of the valve assembly of FIG. 3A.

The anchor assembly 50 as shown in FIG. 2 has a cylindrical body 501 with an upper neck 502; a fluid flow bore 503 from an upper end 504 to a lower threaded end 505; and one, two (or more) stationary slips 506 held to the body 501 with screws 507. One (or more) bow spring 508 has an end 509 screwed to the body to offset the body from the interior of a tubular such as casing through which the body moves to reduce wear thereon and, in one aspect, to inhibit or prevent wear on the stationary slips, the or each bow spring 508 has an end 510 free to move in a recess 511 as the bow spring is compressed or released.

A hollow barrel assembly 520 which is cylindrical has an end 521 threadedly connected to the lower threaded end 505 of the body 501. A hollow anchor sleeve 530 is threadedly connected in a lower end 522 of the hollow barrel assembly 520. A sleeve plug 531 closes off the lower end of the hollow anchor sleeve 530 to fluid flow and is secured to the barrel assembly, e.g. by welding.

A piston assembly 540 has a piston end 541 with fluid flow holes 582 (see FIG. 2A which shows two of four such holes) is mounted for movement within the hollow barrel assembly 520 with a lower end 542 initially projecting into the hollow anchor sleeve 530. Initially movement of the piston assembly is prevented by one or more shear screws 532 extending through the anchor sleeve 530 and into the lower end 542 of the piston assembly 540. In one aspect the shear screws 532 are set to shear in response to a force of about 5000 pounds.

A fluid flow bore 543 extends through the piston assembly 540 from one end to the other and is in fluid communication with a cavity 533 defined by the lower end surface of the piston assembly 540, the interior wall of the anchor sleeve 530, and the top surface of the sleeve plug 531. A spring 544 disposed around the piston assembly 540 has a lower end that abuts an inner shoulder 523 of the hollow barrel assembly 520 and a lower surface 545 of the piston end 541 of the piston assembly 540. Upon shearing of the shear screws 532, the spring 544 urges the piston assembly 540 upwardly. A lower shoulder 546 of the piston assembly 540 prevents the piston assembly 540 from moving any lower than is shown in FIG. 1.

A bar 547 has a lower end 548 resting against the piston end 541 and an upper end 549 that is free to move in a channel 509 of the body 501 to contact and push up on a movable slip 550 movably mounted to the body 501 (e.g. with a known joint, a squared off dovetail joint arrangement, a dovetail joint arrangement, or a matching rail and slot configuration, e.g. but not limited to a rail with a T-shaped end movable in a slot with a corresponding shape).

Fluid under pressure for activating the anchor assembly 50 is conducted from the fluid flow bore 503 of the body 501 to the fluid flow bore 543 of the piston assembly 540 by a hollow stem 560 that has a fluid flow bore 561 therethrough from one end to the other. The hollow stem 560 has a lower end 562 threadedly secured to the piston end 541 of the piston assembly 540 and a upper end 563 which is freely and sealingly movable in the fluid flow bore 503.

A shearable capscrew 580 in the body 501 initially insures that the movable slip 550 does not move so as to project outwardly from the body 501 beyond the outer diameter of the body 501 while the system is being run into a hole or tubular. In order to set the anchor assembly, the force with which the bar 547 contacts and moves the movable slip 550 is sufficient to shear the capscrew 580 to permit the movable slip 550 to move out for setting of the anchor assembly. Initially the capscrew 580 moves in a corresponding slot (not shown) in the movable slip 550. The slot has an end that serves as a stop member that abuts the capscrew 580 and against which the capscrew 580 is pushed to shear it. Similarly the capscrew 581 prevents the movable slip 550 from further movement out from the body 501 as the anchor assembly is being removed from a wellbore and/or tubular member string. The capscrew 581 is held in and moves in a slot in the movable slip 550 and the capscrew 581 thus holds the movable slip 550. This prevents the movable slip 550 from projecting so far out from the body 501 that removal of the anchor assembly is impeded or prevented due to the movable slip 550, and hence the anchor assembly 50, getting caught on or interfering with structure past which it must move to exit the wellbore and/or tubular member string.

Various O-rings (e.g. made of 90 DURO nitrile) seal interfaces as follows: O-ring 571, sleeve-plug 531/hollow-sleeve 530; O-ring 572, lower-end 542/hollow-anchor-sleeve 530; O-ring 573, piston-end 541/lower-end 562; O-ring 574, upper-end 563/body 501; O-ring 575, bar 547/body 501; and, O-ring 576, upper-neck 502/lower-end-of-whipstock 40.

Components of the system may be made of any suitable metal (steel, stainless steel, mild steel, inconel, iron, zinc, brass, or alloys thereof) or plastic. In one aspect the system has two stationary slips and one movable slips. All parts may be painted and/or zinc phosphate coated and oil dipped.

To load the piston assembly in the hollow barrel assembly, the piston assembly may be introduced into the top of the barrel assembly with a threaded rod engaging the lower end of the piston assembly and projecting out from the anchor sleeve. The threaded rod is pulled or rotated until recesses on the piston assembly for receiving the shear screws line up with holes through the barrel assembly through which the shear screws are placed. Once the piston assembly is shear screwed in place and stationary, the threaded rod is disengaged and the sleeve plug is secured in place at the end of the anchor sleeve.

The fluid under pressure for actuating the anchor assembly may be any suitable pumpable fluid, including but not limited to water, hydraulic fluid, oil, foam, air, completion fluid, and/or drilling mud.

Once the movable slip 550 is sufficiently wedged against a casing wall, the spring 544 prevents the piston assembly 540 from moving down to the position shown in FIG. 2A, thus inhibiting or preventing movement of the movable slip 550 which could result in unwanted movement or destabilization of the system 10. This also makes it possible to decrease fluid pressure in the system 10 or to release fluid pressure while the system 10 is maintained in a set position (e.g. when anchoring of the system is verified, e.g. with the system in the position of FIG. 5D, weight is set down on the system 10 to obtain an indication that setting has been achieved, e.g. a surface weight indicator provides such an indication).

The whipstock 40 has a body 401 with a concave 402; a shear lug 403; a retrieval slot 404; a hoisting ring 405; and a lower end 406 for interconnection with the upper neck 502 of the anchor assembly 50. Shear screw(s) 413 extend through the whipstock body 401 and the neck 502 of the anchor assembly 50. These screws may be set to shear, e.g. at about 27,500 pounds.

The tubing 12 has a lower end 14 that communicates with a fluid channel 407 which extends from one side of the whipstock body 401 to a recess 408 where it is connected to a top end 409 of a tubing 410 that has a lower end 411 that communicates with a fluid channel 412 which itself is in fluid communication with the fluid flow bore 503 of the anchor assembly 50. Alternatively the tubing 12 may be directly connected to the anchor assembly 50 or to the fluid channel 412. One or more shear screws 413 releasably hold the anchor assembly 50 to the whipstock 40. In one aspect three shear screws 413 are used which shear in response to a force of about 80,000 pounds.

The mill 30 is connected to the whipstock 40 with a shear stud 310 that extends through a lower end of the mill 30 and into the shear lug 403. The mill 30 has a body 301 to which are secured milling blades 302 as are well known in the art. The mill body 301 has a fluid flow bore 303 which communicates with jetting ports 304 with exits adjacent the blades 302. A sub-channel 305 provides fluid communication between the fluid flow bore 303 and the tubing 12. In one aspect the fluid flow bore is sized so that it can receive a plug disengaged from the valve assembly 20 as described below.

FIGS. 3A–3J show the valve assembly 20 and parts thereof. The valve assembly 20 has a top bushing 201 threadedly connected to a valve body 202. A bottom bushing 230 is connected to a lower end of the valve body 202. A piston 203 is movably mounted in a bore 231 of the valve body 202. A plug extension 204 is movably mounted in the valve body 202 with a lower end 232 thereof projecting into and through the lower bushing 230 with respect to which the plug extension 204 is movable up and down. An upper end 233 of the plug extension 204 is threadedly connected in a lower end 234 of the piston 203.

A ratchet sleeve 208 is rotatably disposed around the plug extension 204. A lug 206 projects through the valve body 202 into a multi-branched slot 235 of the ratchet sleeve 208. A spring 207 abuts an upper end 236 of the lower bushing 230 and pushes against (upwardly) a thrust bearing set 238 at a bottom 237 of the ratchet sleeve 208 (see FIG. 3C). A releasable plug 205 initially closes off the lower end 232 of the plug extension 204 to fluid flow. A thrust bearing set 239 is disposed between a top 240 of the ratchet sleeve 208 and the lower end 234 of the piston 203 (see FIG. 3B). This use of thrust bearings inhibits undesirable coiling of the spring 207 and facilitates rotation of the ratchet sleeve 208. The thrust bearing sets may include a typical thrust bearing sandwiched between two thrust washers. Shear screws 215 secure the plug 205 to the plug extension 204. In one aspect two shear screws 215 are used and they shear in response to a force of about 4000 pounds.

A cap 241 emplaced in and welded to a trough 242 serves to define the outer wall of a channel 243 formed between the cap 241 and the exterior of the body 202.

O-rings seal a variety of interfaces: O-ring 212, mill 30/plug extension 204; O-ring 213, plug 205/interior-of-plug-extension 204; O-ring 209, valve-body 202/bottom-bushing 230; O-ring 211, plug-extension 204/piston 203; O-ring 246, piston 203/valve-body 202; O-rings 245 and 247, piston 203/valve-body 202; O-ring 210, piston 203/valve-body 202; O-ring 214, lug 206/body 202; and O-ring 244, valve-body 202/top-bushing 201.

The valve body 202 has a series of ports 249 that permit fluid to flow through the valve body 202 and ports 251 that also permit such fluid flow. The top bushing 201 prevents further upward movement of the piston 203. FIG. 3F shows a cross-section view of the trough 242.

Figure 3B:
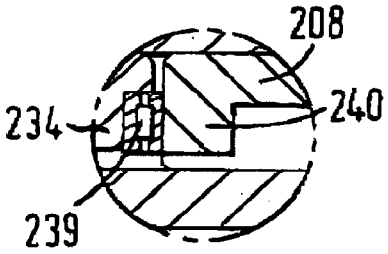
FIGS. 3B–3L are side views in cross-section of parts of the valve assembly of FIG. 3A.
Figure 3C:
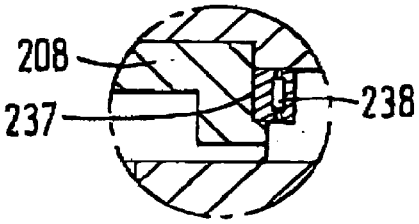
Figure 3A:
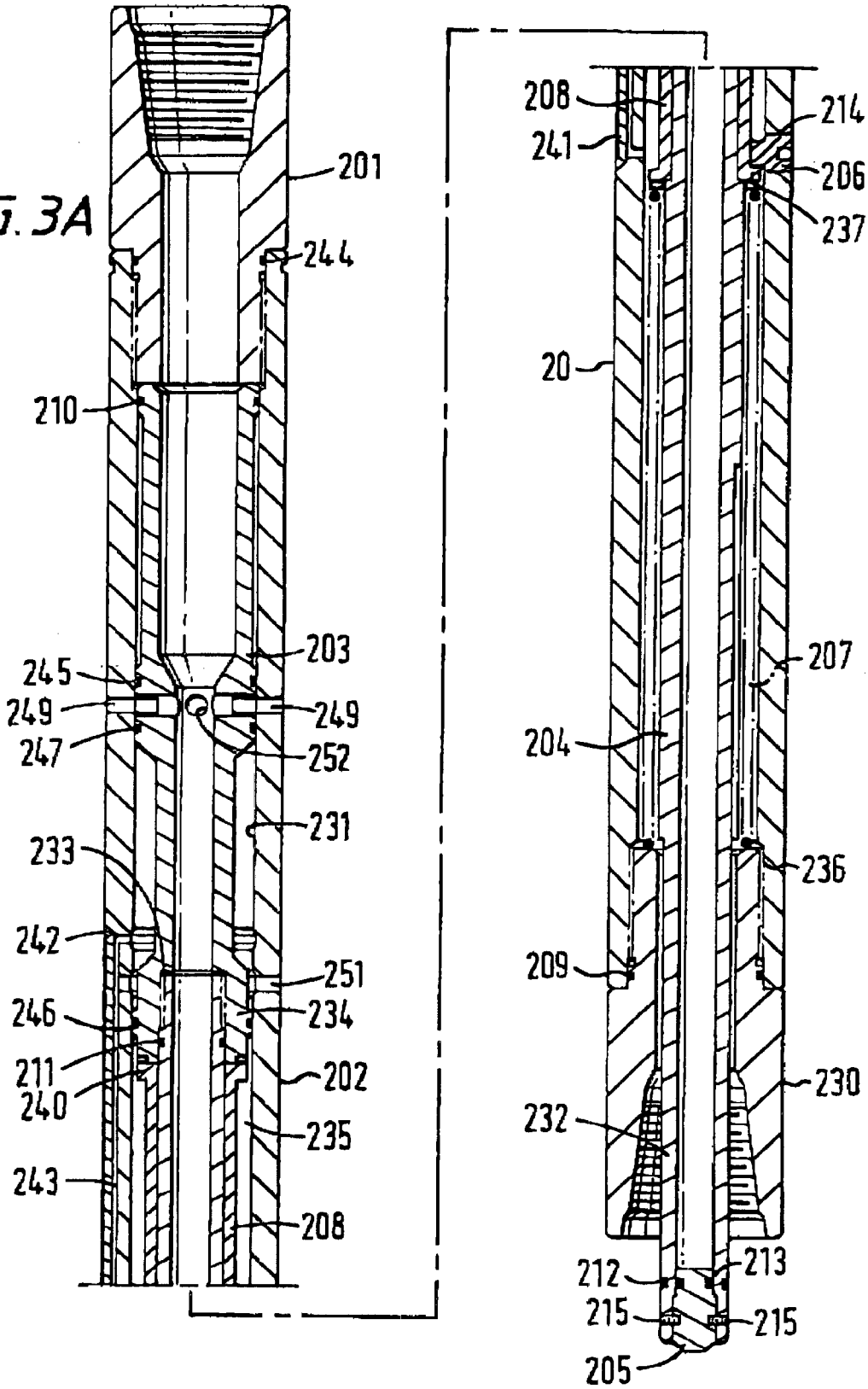
FIG. 3A is a side view in cross-section of the valve assembly of FIG. 1.
Figure 3E:
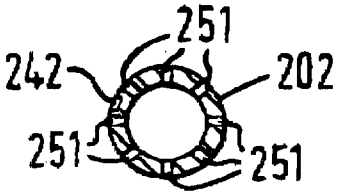
Figure 3F:
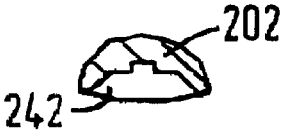
Figure 3D:
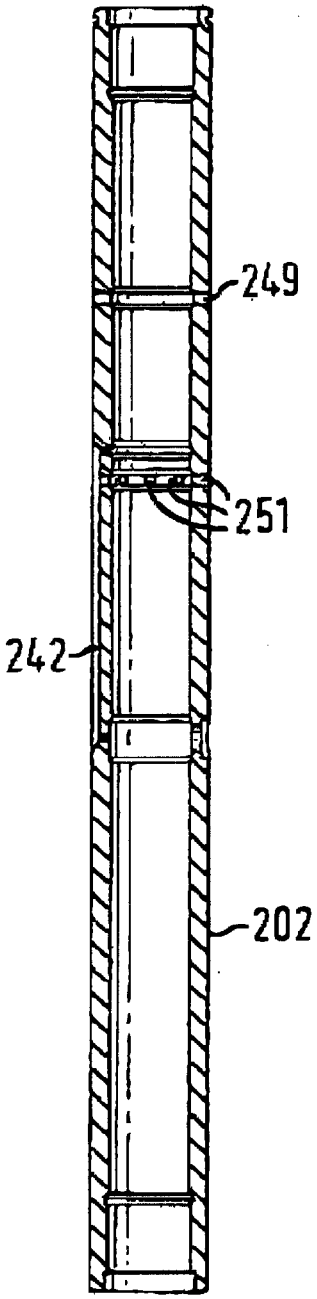
Figure 3G:
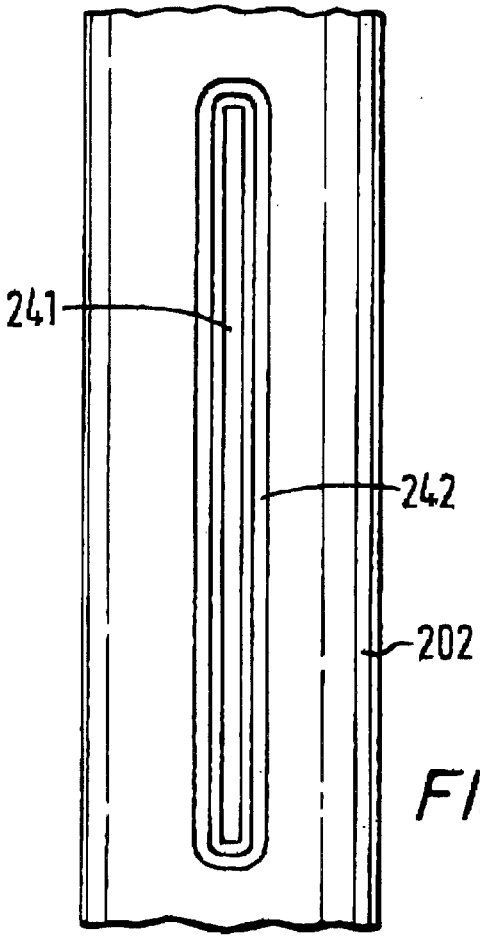
Figure 3H:
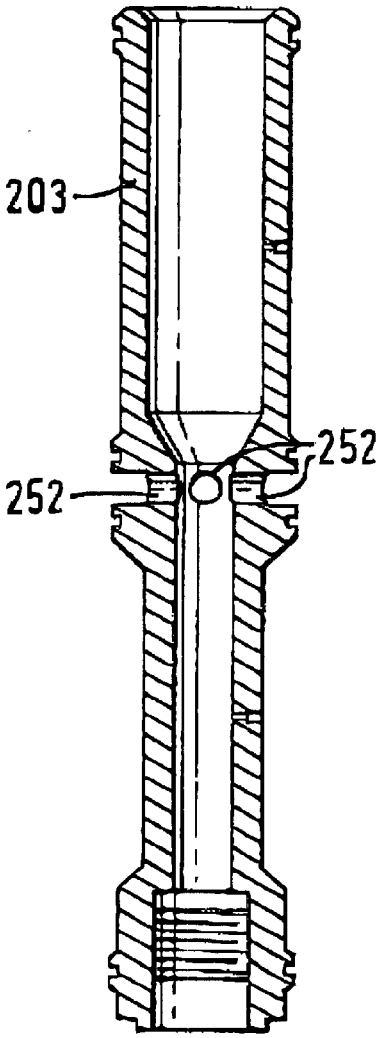
Figure 3I:
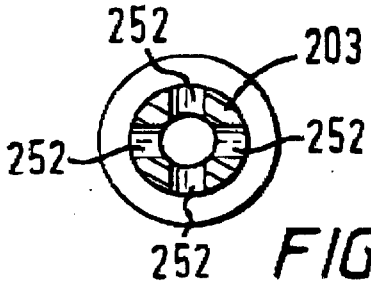

The piston 203 as shown in FIGS. 3A, 3H and 3I, has a series of fluid ports 252 and the piston can be moved so the fluid ports 252 align with the valve body ports 249 or 251 for fluid intercommunication therewith.

Figure 3J:
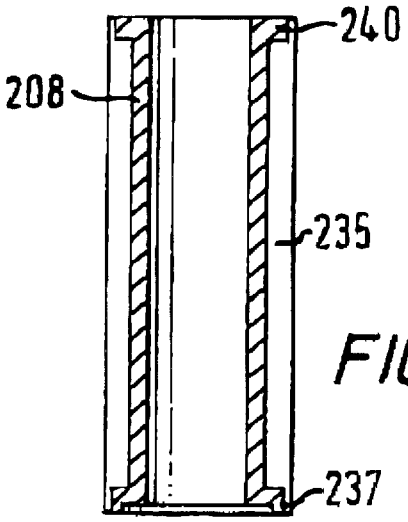
Figure 3L:
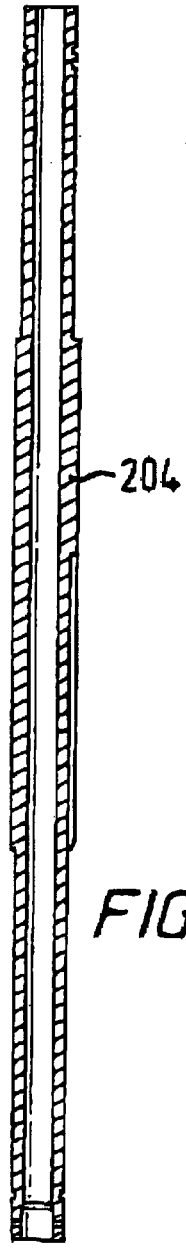
Figure 3K:
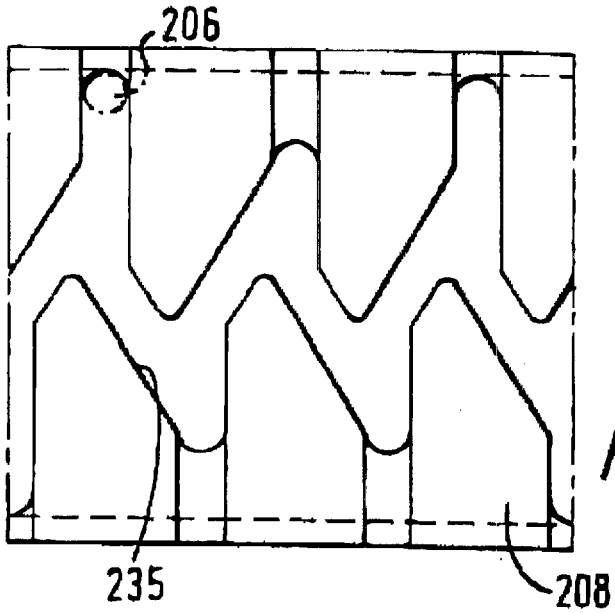

FIGS. 3A, 3J, and 3K show the ratchet sleeve 208 and the multi-branch slot 235 in which moves the lug 206.

FIG. 3L shows the plug extension 204.

FIG. 4 and FIGS. 5A–5F illustrate a sequence of operation of the system 10 and the corresponding movement of and positions of the lug 206 and of the ratchet sleeve 208.

Figure 5A:
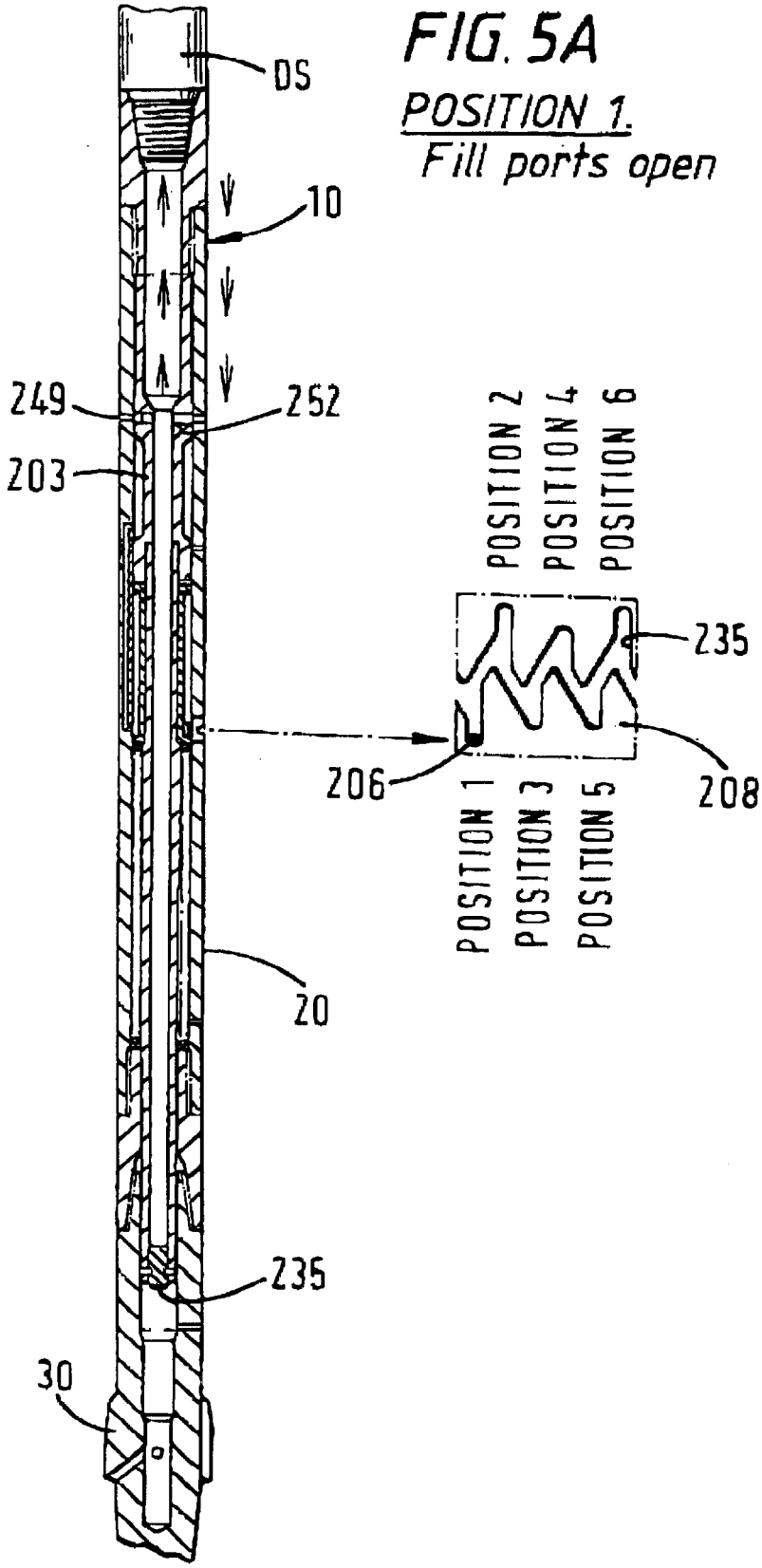
FIGS. 5A–5F show a sequence of operation of the system of FIG. 1.

FIG. 5A illustrates the system 10 in a "run-in-the-hole" situation. The ports 252 and 249 are aligned so fluid from outside the system 10 (e.g. drilling fluid between the exterior of the system 10 and the interior of borehole casing, not shown) may flow, as indicated by the arrows, through the system 10 and up into a drill string to which the system 10 is connected. The lug 206 is in "Position 1" in the multi-branch slot 235.

Figure 5B:
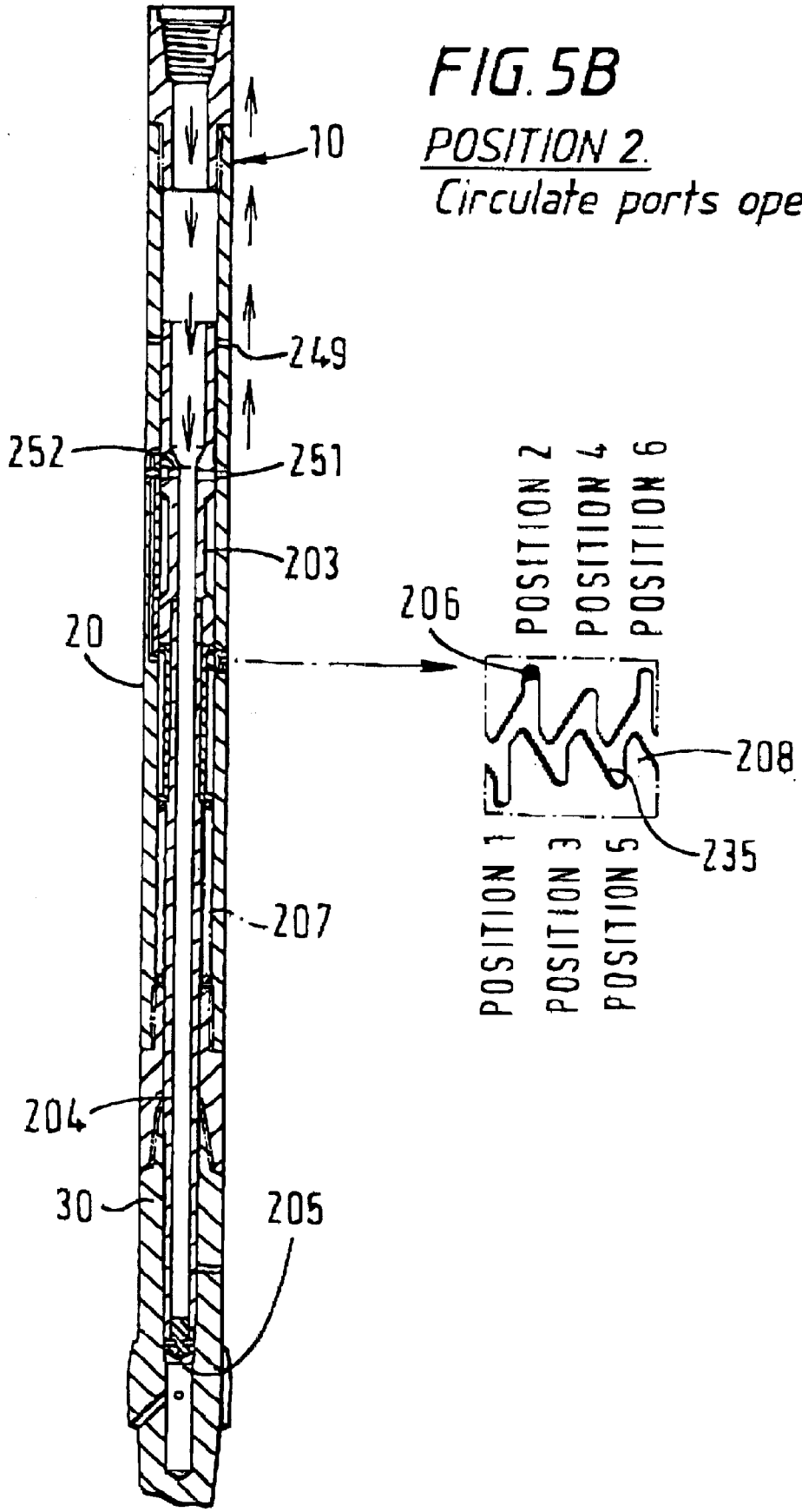

As shown in FIG. 5B, fluid under pressure is pumped from the surface down the drill string into the system 10 with sufficient force to move the piston 203 to the position shown, with the ports ports 251 aligned with the ports 252 permitting fluid pumped down the drill string to flow out from the system 10. The lug 206 moves to the "Position 2" in the ratchet sleeve 208. (The multi-branch slot 235 is continuous around the ratchet sleeve 208 so that the sequence of operation of the system is repeatable as required). In this position fluid may be circulated out from the system 10 to clean the hole at the point at which it is desired to set the system 10, e.g. To-do remove debris and other material that might interfere with proper system functioning and positioning.

Figure 5C:
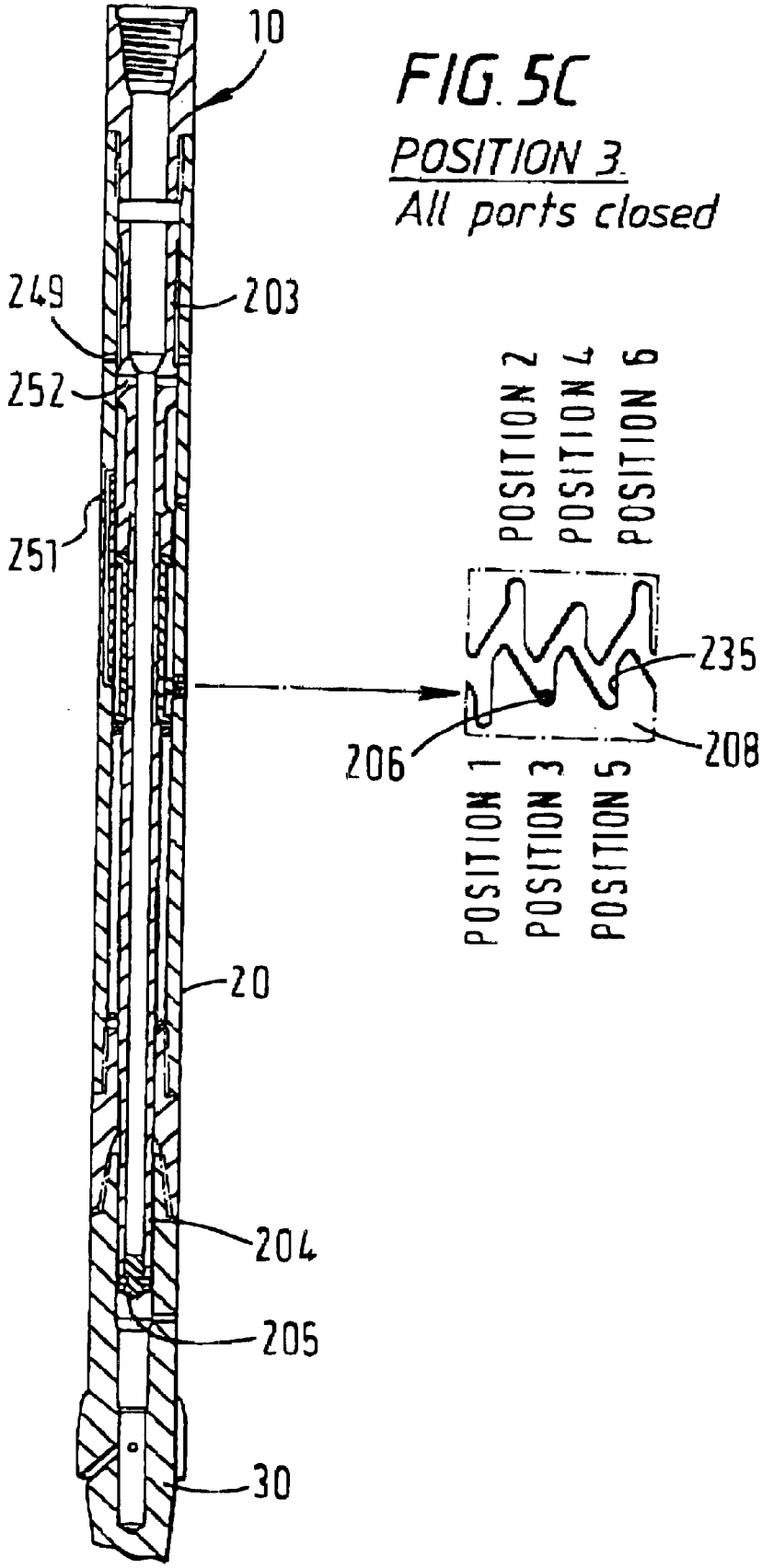

With the system 10 as shown in the position of FIG. 5C, flow is not permitted through the ports 249, 251, and 252 and fluid does not yet flow down to the anchor assembly 50.

Figure 5D:
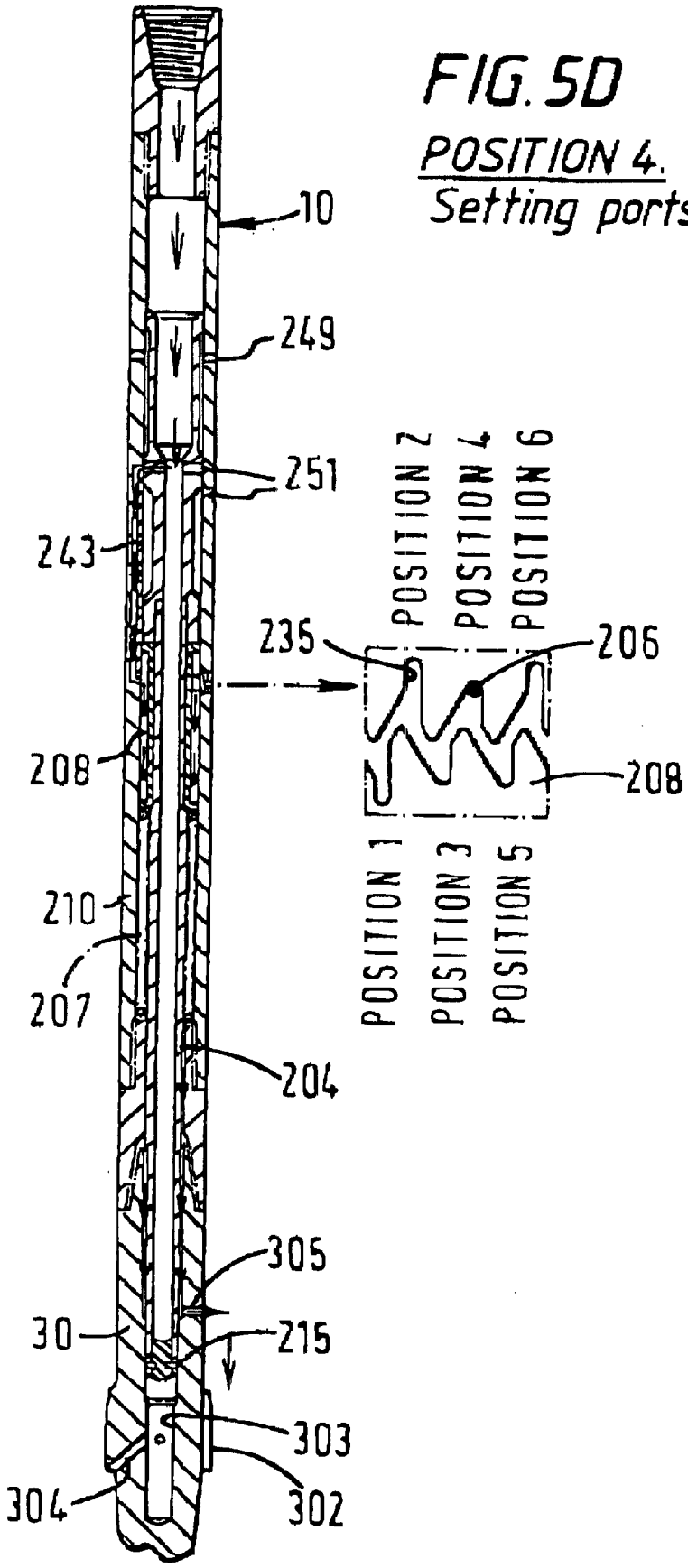
Figure 5E:
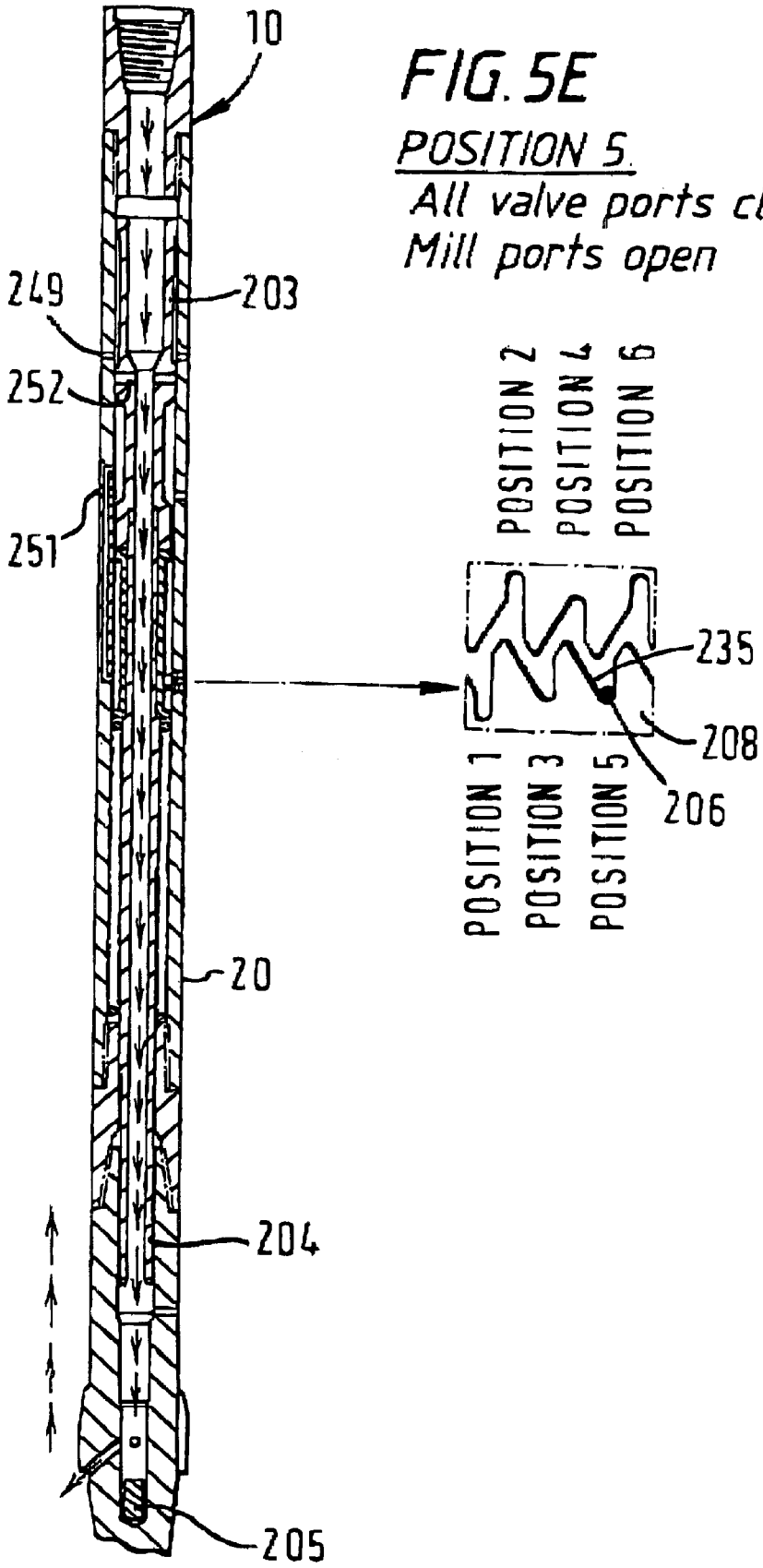

As shown in FIG. 5D, the pressure of fluid flowing into the system has been increased, further moving the piston 203 so ports 252 align with the channel 243. The fluid under pressure flows from the channel 243, past the ratchet sleeve 208, past the spring 207, between the bushing 203 and the plug extension 204, out the sub-channel 305 of the mill body 301 into the tubing 12 (see FIG. 1). The lug 206 moves into "Position 4" as shown. The fluid under pressure flows through the tubing 12, through the whipstock 40, through the anchor assembly 50 into its cavity 533 where it pushes up on the piston assembly 540, shearing the shear screws 532 so the bar 547 is moved up to move the movable slip(s) 550 and set the anchor assembly 50, and thereby set the system 10 at the desired location. Once proper anchoring has been achieved and verified, an appropriate load is applied to the string to which the system 10 and the mill 30 are connected (e.g. about 30,000 pounds) to shear the shear stud 310 to separate the mill 30 from the whipstock 40. Then as shown in FIG. 5E, pressure is increased against the plug 205 which is then released by shearing of the shear screws 215, thereby releasing pressure which was required to set the moving slip, and the spring 207 has pushed upwardly moving the ratchet sleeve 208 and the piston 203 so that all ports (249, 251, 252) are closed to fluid flow and fluid is diverting through the jetting ports 304. The lug 206 is now in "Position 5." Milling now commences. Upon completion of a desired window in casing adjacent the mill 30, the whipstock 40 may be retrieved by using a hook which is inserted into the retrieval slot 404 or by screwing a die collar onto the outer diameter threads (not shown) provided at the top of the whipstock 40. Alternatively, an overpull is applied to the whipstock (e.g. about 82,500 pounds) shearing the shear screws 413 allowing retrieval of the whipstock while leaving the anchor assembly in the hole and/or tubular member string. Such a shearable neck is disclosed in pending U.S. application Ser. No. 08/590,747 entitled "Wellbore Milling Guide" filed on Jan. 24, 1996 and co-owned with the present invention and application and incorporated herein by reference fully and for all purposes.

Figure 5F:
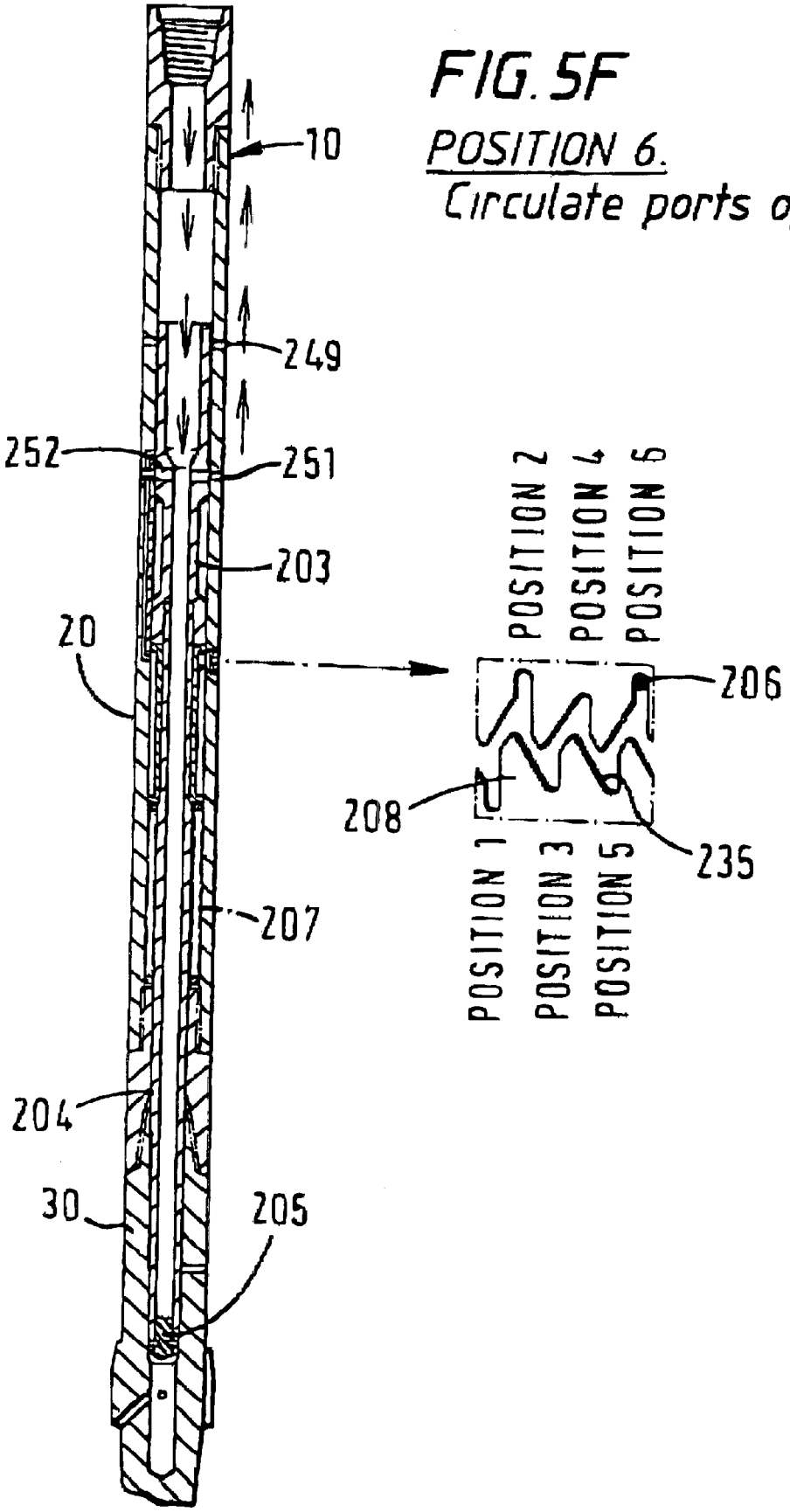

Repetition of the cycle of operation of the system as shown in FIGS. 5A–5F, or of only a portion of the cycle, is possible; e.g., but not limited to as shown in FIG. 5F, cycling back to Position 1 is possible if necessary. Also, if when weight is set down there is an indication that the anchor assembly is not set as desired, the setting sequence can be repeated. Fluid under pressure is again circulated down the drill string and out from the system (to again clean the hole, if desired) and the process of FIGS. 5A–5E is begun again.

It is within the scope of this invention to use an anchor assembly, a valve assembly, and/or a mill according to this invention with any downhole apparatus, device, tool, or combination thereof.

FIG. 6A shows a system 600 which is like the system of FIG. 1, but which has a valve assembly 602 that has a ratchet sleeve 604 (positioned as the ratchet sleeve 208, FIG. 3A) but with only four positions for a lug 605 (see FIG. 6B) rather than the six positions of the valve assembly 20. The ratchet sleeve 604 encompasses the 360° circumference of the tool. With the system 600 an operator at the surface has a positive indication that the system has gone from a "fill" or "at rest" position (Position 1) to a "circulate" position (Position 2). The operator at the surface monitors a pressure level (pressure of fluid at a pump outlet or "standpipe pressure") and monitors fluid returns from the wellbore; i.e., in the "circulate" position a positive pressure is required and indicated and the operator sees returned to the surface fluid that was pumped down the system.

The system 600 has a starting mill 610 with an auto-fill setting device 620. The auto-fill setting device 620 is in a top part 621 of a mill body 634 that threadedly engages a control valve bushing 606 of the valve assembly 602. A holder assembly 622 has an upper shoulder 623 that rests on a top end 624 of the top part 621. An o-ring 625 seals the top part/holder assembly interface. An o-ring 626 seals the interface between the holder assembly 622 and a ball seat 627 that is initially releasably secured in the holder assembly 622 by shear screws 628. A ball 629, e.g. made of plastic or metal (e.g. stainless steel) is movably disposed in a flow bore 630 of the holder assembly 622. The ball 629 is movable to seat against a top seat 631 of the ball seat 627 to prevent fluid passage out through the bottom of the housing 621. Upon shearing of the shear screws 628, the ball 629 and ball seat are movable down in a bore 632 of the mill 610 (see FIG. 10D) past eight jet ports 633 of the mill 610.

The 610 is connected to a whipstock 640 (like the whipstock in FIG. 1) which is connected to an anchor assembly, not shown (like that of FIG. 1).

A pin 637 prevents the ball 629 from exiting the holder assembly 622. The pin 637 does not close off flow through the holder assembly 622. A keeper 635 in FIG. 9A is used with the shorter than standard bore back box of the bushing of FIG. 9A and prevents the holder assembly from exiting from the top of device 620. FIG. 9C shows an alternative keeper 636 for use with a standard bore back box which is longer than that of FIG. 9A.

FIG. 9B shows an alternative to the ball and seat of the 5 system of FIG. 9A. A plug 646 releasably held by the shear screws 628 may be used with the ball and seat removed.

The valve assembly 602 has no fill ports at the top thereof. It does have circulation ports 650. The eight jet ports 633 of the mill 610 act as fill ports when the system is run into a wellbore so that fluid in the wellbore can enter the system 600.

Figure 10A:
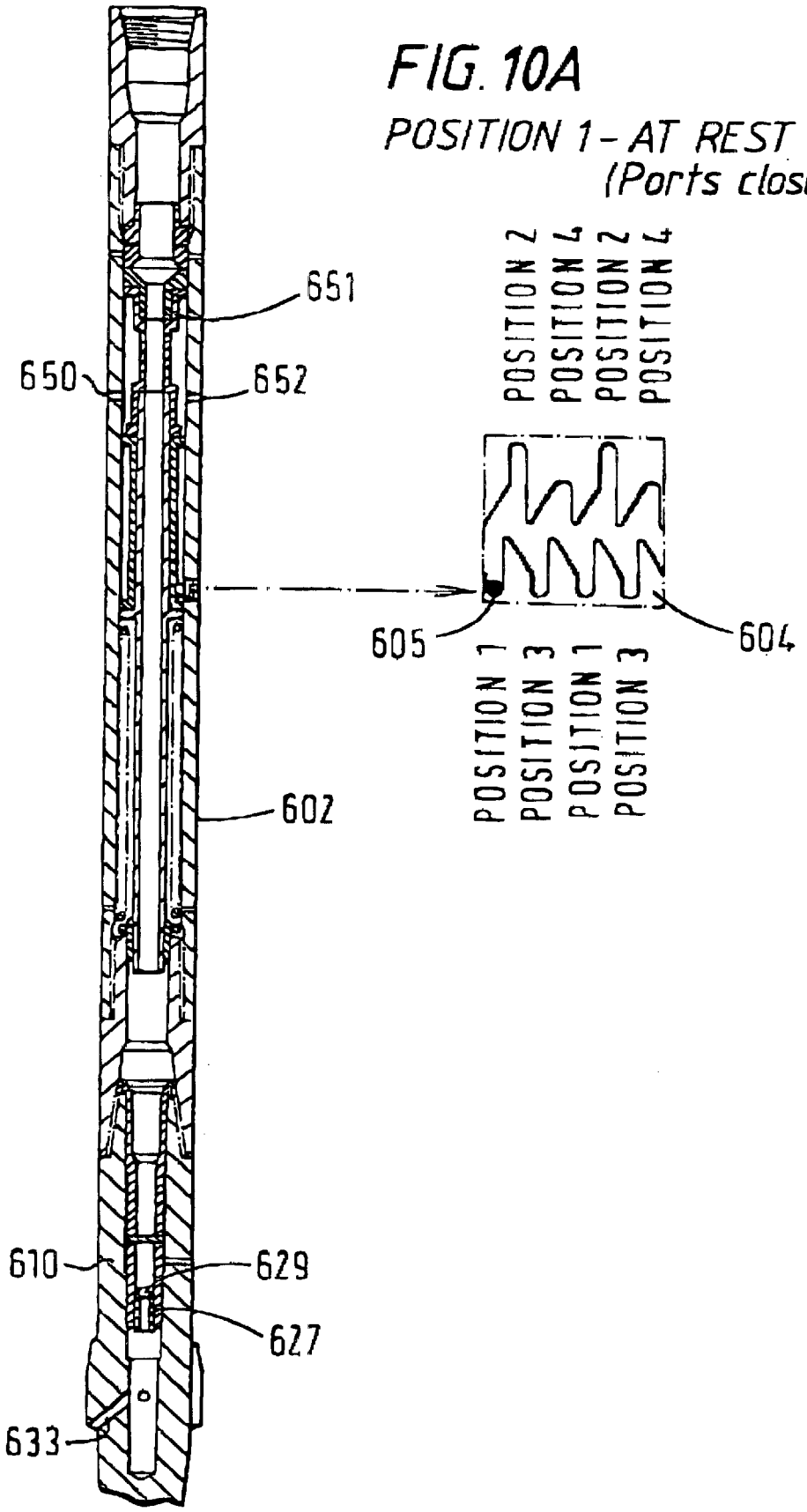
FIGS. 10A–10D show steps in the operation of the valve assembly of FIG. 6A.
Figure 11A:
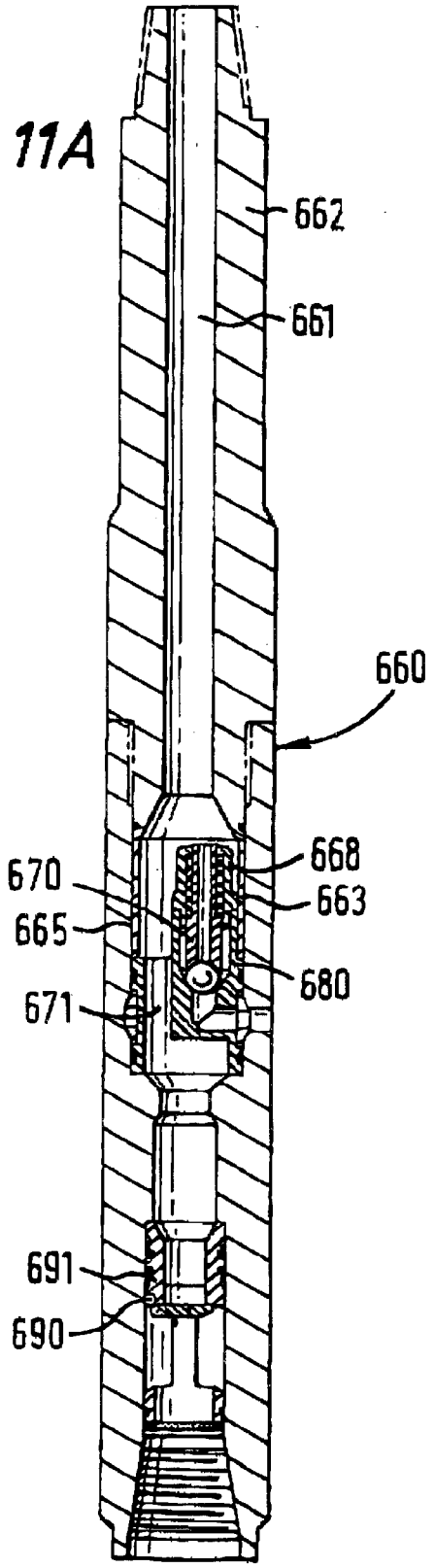
FIG. 11A is a side cross-section view of a fill sub according to the present invention.
Figure 11B:
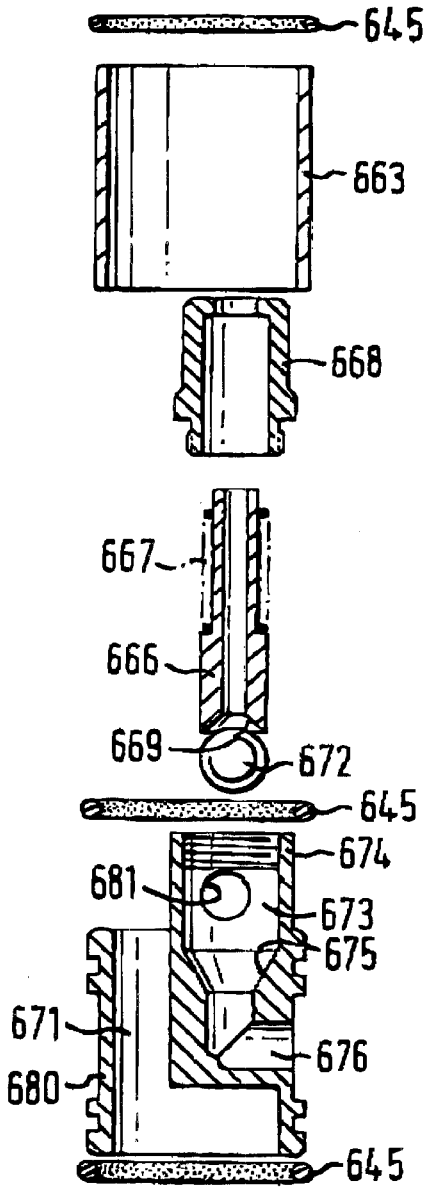
FIG. 11B is an exploded view of the fill sub of FIG. 11A.
Figure 11C:
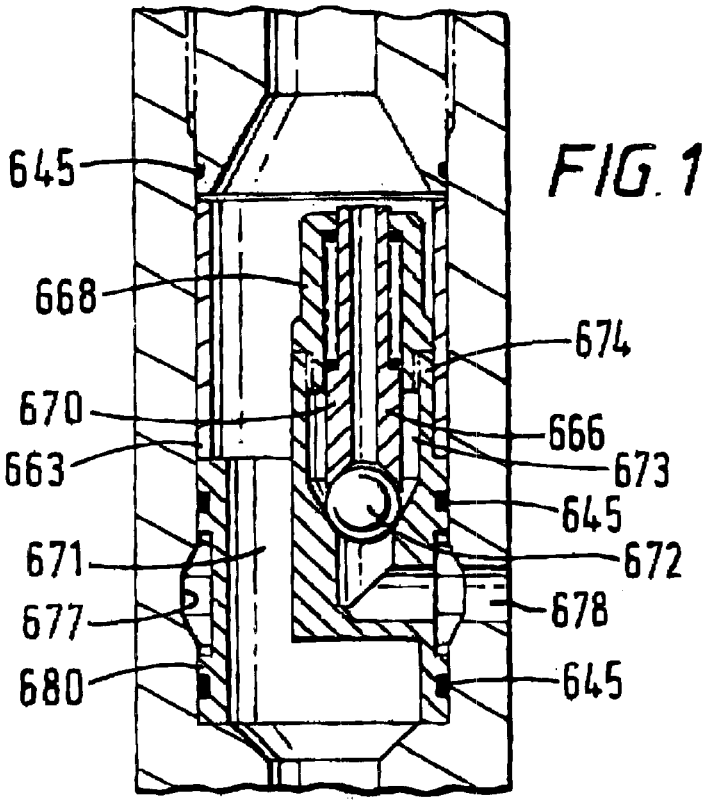
FIG. 11C is an enlarged view of part of the fill sub of FIG. 11A.
Figure 11D:
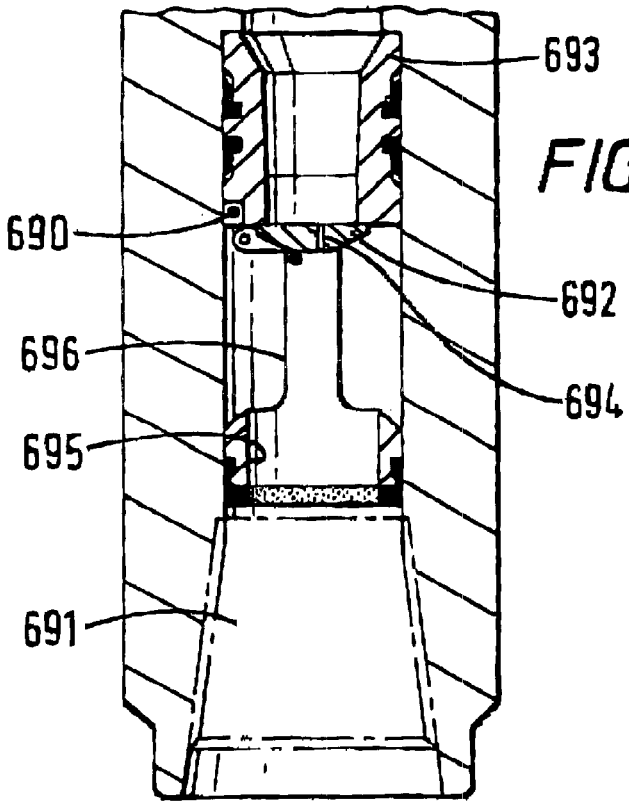
FIG. 11D is an enlarged view of part of the fill sub of FIG. 11A.

FIG. 10A shows a "run in" position for the system 600 with the circulation ports 650 closed (i.e., a top end 651 of a piston 652 block fluid flow to the ports 650). In the "run in" position of FIG. 10A, fluid in the wellbore enters the system 600 through the ports 633, pushing the ball 629 off the seat 631. (Alternatively as shown in FIG. 11A and described below, a fill sub with a ball/seat mechanism or with solid plug can be used above or below the valve assembly 602 instead of the ball and ball seat of FIG. 6A.)

Figure 10B:
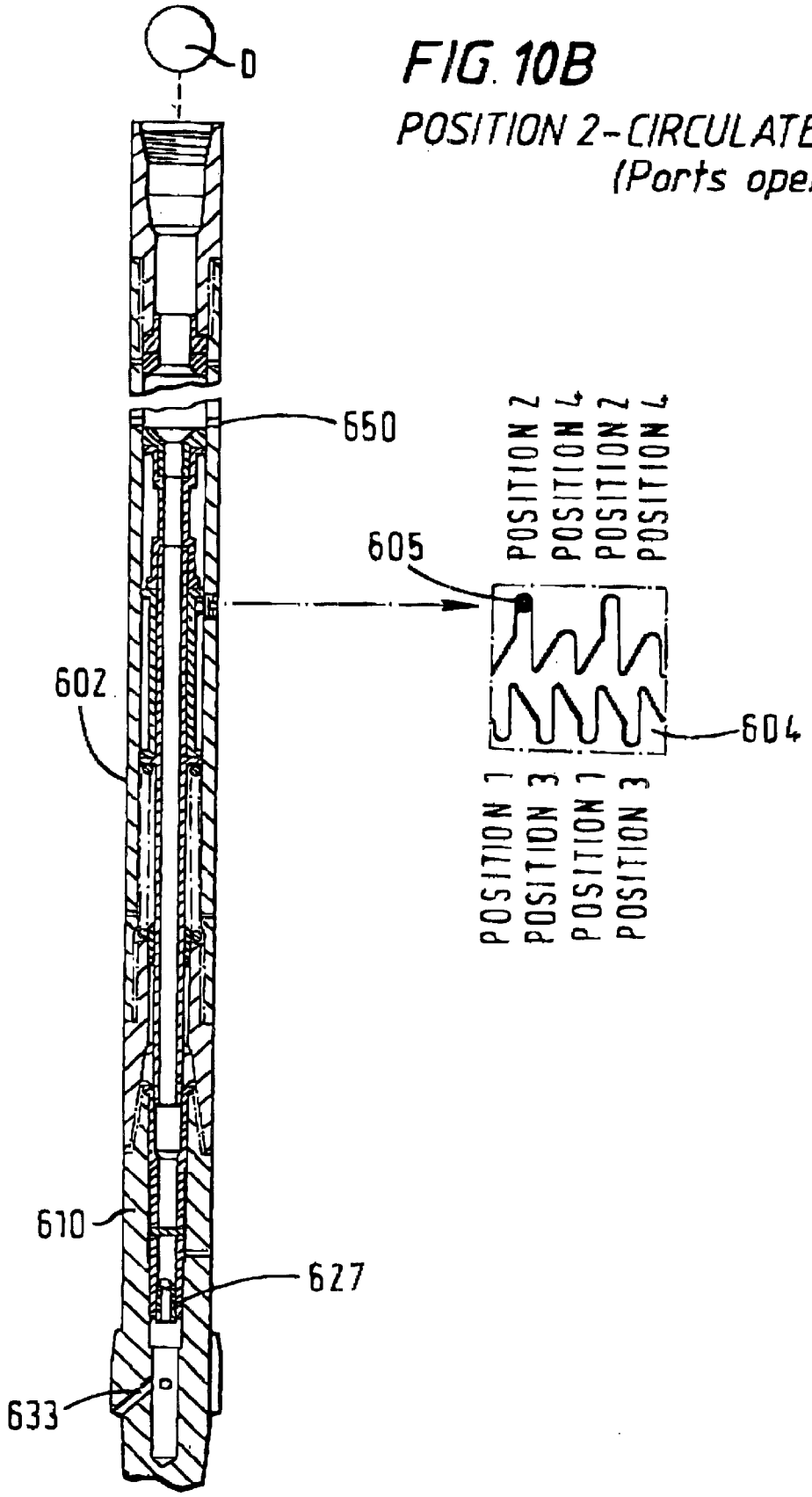

FIG. 10B shows the system in a circulation mode. Fluid pumps at the surface pump fluid (e.g. water, brine, drilling mud, etc.) down into the valve assembly 602, moving the ball 629 against the seat 631. Pressure builds up and, due to a pressure differential between the area of the keeper 635 and the larger area at the top of the piston 651, the piston 652 moves down to uncover the ports 650 for the circulation of fluid into the wellbore annulus. In the position of the system shown in FIG. 10A, a sufficient fluid pumping rate is achieved to activate an MWD tool D (shown schematically in FIG. 10B) to orient the system 600 and the whipstock 640. The system 600 is properly oriented and operations proceed.

Figure 10C:
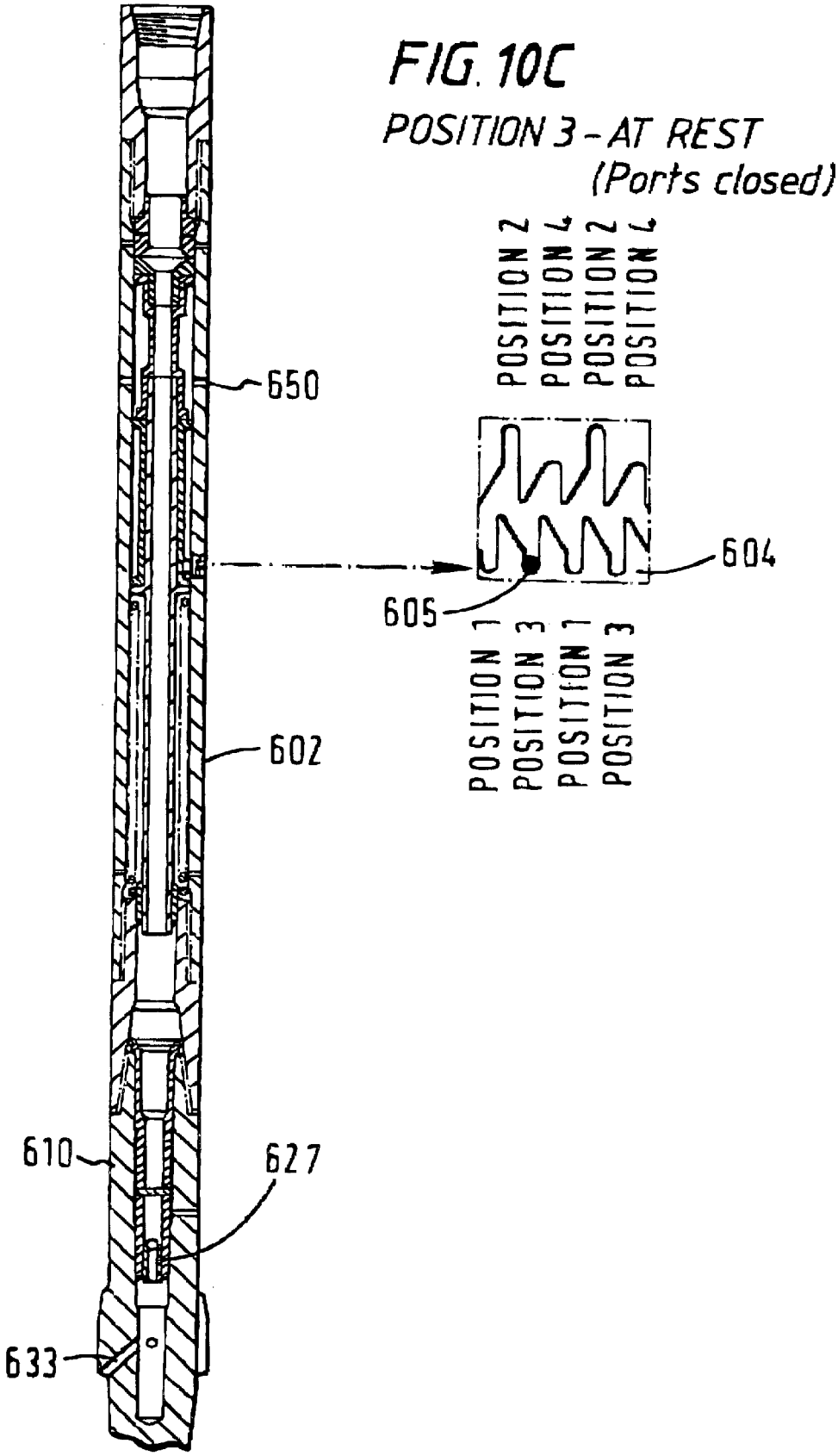

FIG. 10C shows the cessation of the surface pumps with fluid flow stopped. This is an intermediate position of the system 600 on the way to the position of FIG. 10D.

Figure 7:
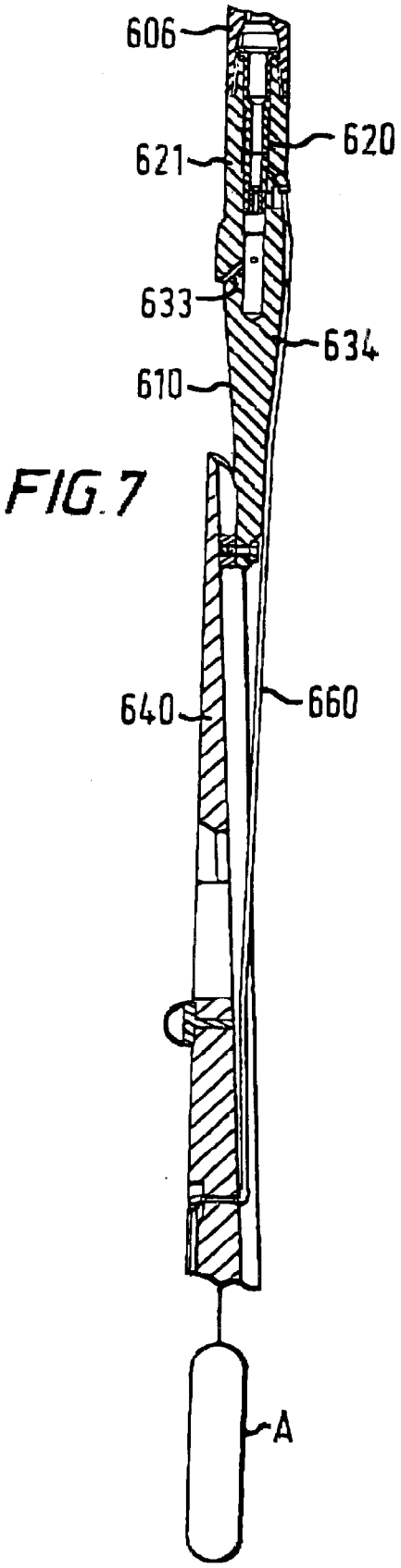
FIG. 7 is a side cross-section view of the mill (entire) of FIG. 6A with a whipstock (partial).
Figure 10D:
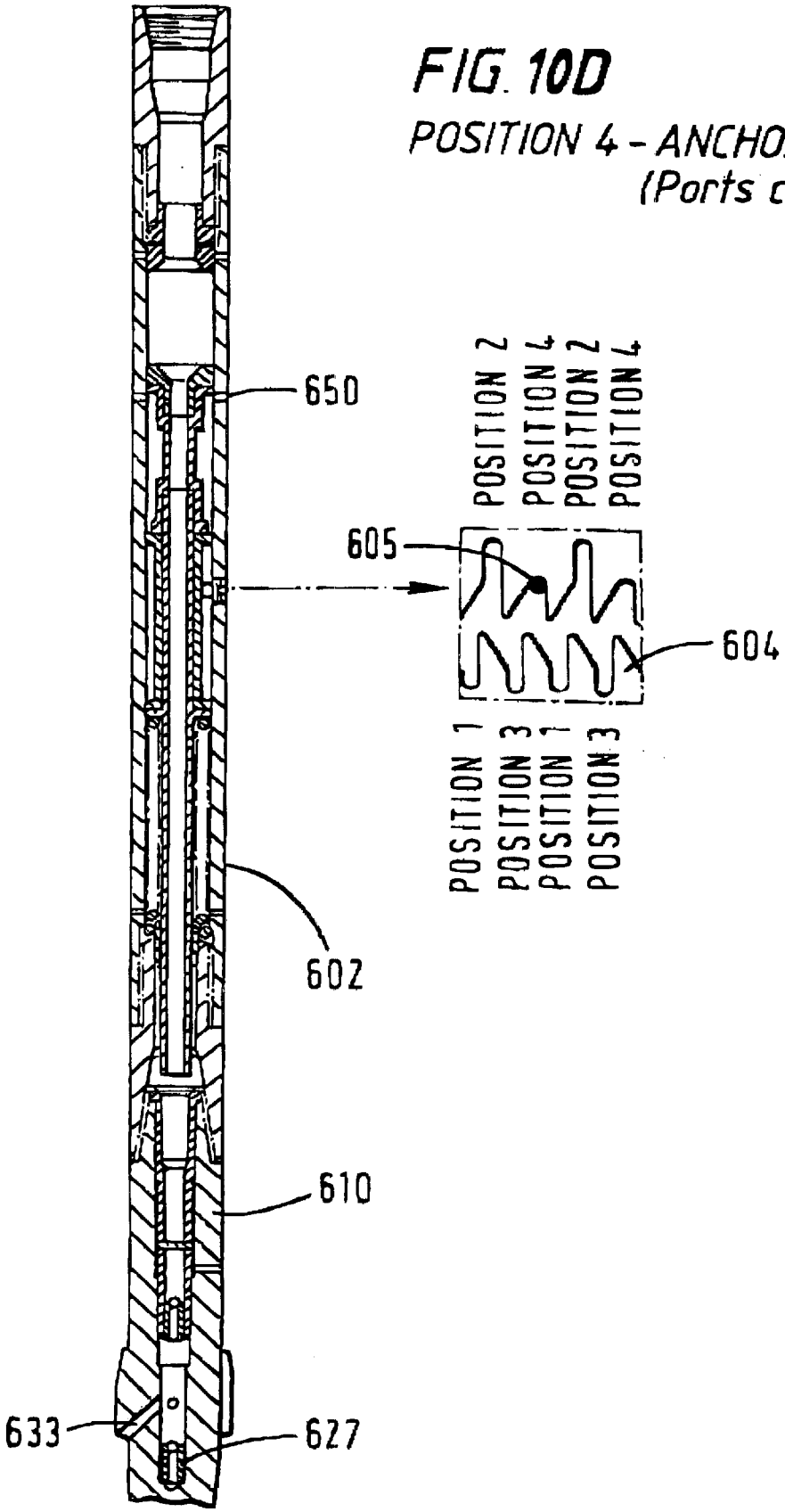

FIG. 10D shows the system 600 with fluid again pumped from the surface down to the system 600. The lug 605 moves into "Position 4" and the piston 652 does not move down sufficiently to open the ports 652 (i.e., it does not move down as far as it did in "Position 2," (FIG. 10B). Pressure increases within the system 600 and fluid flows through tubing 660 to an anchor assembly A (shown schematically in FIG. 7) (like the anchor assembly of the system of FIG. 1) to set the anchor assembly in the wellbore. The tubing 660 connects to and is in communication with a hole 643 and thereby with the interior of the top of the mill.

After the anchor assembly is set, pumping pressure is increased (e.g. an additional thousand pounds) to shear the shear screws 628 so that the ball 629 and ball seat 627 are moved down into the bottom of the bore 632 of the mill 610, exposing the ports 633 to fluid flow for fluid jetting action during milling.

Prior to increasing fluid pressure, if it is not desired to set the anchor, e.g. if further circulation is desired prior to setting the anchor, the pump(s) are stopped and the system 600 is returned to "Position 1" (FIG. 10A) for further circulation (e.g. To-do clean out the wellbore). The system 600 is either in a "pressured up" position, "Position 4" or in a "circulate" position, "Position 2." An operator is aware of which position the system is in by monitoring the fluid pressure level and the returned well fluids. Thus inadvertent anchor setting is avoided.

In one aspect the valve assembly of FIG. 6A acts like a control valve, essentially as an on/off toggle valve which is designed, in one aspect for use with MWD (measurements-while-drilling) orienting systems. If it is pushed down once (with fluid from surface pumps), flow passes through the control valve to the annulus. If it is pushed down again, flow paths are blocked, allowing pressurizing of the string (and hence setting of the whipstock), if the bottom of the string is blocked by a device such as the auto-fill setting device (see FIG. 6A). When the pumps are again stopped, the pressure is bled off, and the pumps started again, fluid again passes through the circulation ports into the annulus. This cycle is repeated as many times as required during orientation or other circulation activities until proper orientation is achieved, at which time the whipstock is set by simply pressuring up to a preset value while the control valve is in an "anchor set" position.

The auto-fill setting device, emplaced in the top of the starting mill 610, can be used without the control valve in situations where circulation prior to whipstock setting is not required (e.g. when orienting with a gyro). The auto-fill setting device, when run with or without the control valve, allows wellbore fluid to automatically fill up the drill string when running in the hole by allowing the ball to float off its seat. When it becomes necessary to pressure up the string to set the whipstock, the ball remains on its seat, blocking the fill port to allow pressurization. A solid plug may replace the ball and seat if the auto-fill feature is not desired.

A keeper is used to keep the auto-fill setting device from moving in the starting mill 610 bore when the starting mill is screwed into a box with a bore-back relief. Minor freedom of movement facilitates proper shouldering of the connector. The box, in one aspect, on the control valve bushing has a bore-back relief that is in some cases one inch shorter than a standard bore-back relief, and therefore requires a keeper one inch shorter than standard. Certain standard keepers have a length of about 1½ inches.

The control valve may or may not be screwed directly onto the starting mill 610. In certain aspects for placement from a hydraulics standpoint, the control valve is placed below an MWD tool so that fluid is allowed to pass through the control valve and through the MWD tool, as required for orientation.

Good solids control practices aid in successful operation of the control valve. In certain aspects the operator circulates "bottoms up" across a shale shaker (120 mesh screens in one aspect) prior to pulling out of the hole to pick up the whipstock. The shale shaker remains in operation until the whipstock is set (or until the control valve is no longer required to function). "Sweeps" or "pills" with high solids of any type are avoided prior to setting the anchor. In addition, a drill pipe screen (such as is usually supplied by an MWD contractor) is in place at the top of the drill string while the control valve is in use. Proper valve operation and anchor setting are facilitated if these procedures are followed.

In one sequence of operation of a valve assembly (control valve) according to the present invention, an operator initiates circulation carefully, observing pump pressure and fluid returns in order to determine valve position. At the surface control valve position is determined based on whether it allows flow, or does not for minor "leakage" through equalization ports). At depth (or whenever circulation is required during a trip in the hole), pumps are started and pump rate is increased slowly. One thousand p.s.i. pump pressure is not exceeded, in one aspect, to initiate circulation. If a rate of 30 gpm is achieved without significant pump pressure (i.e. less than 100 p.s.i.), the control valve is in a "circulate" position. Once pumps are stopped, the valve shifts to an "at rest" position. In order to initiate circulation again, the control valve is first cycled through an "anchor set" position. The pumps are then brought on slowly to shift the control valve into the "anchor set" position. A 1000 p.s.i. pump pressure is not exceeded, and the operator ensures that the string is being pressurized (i.e. pressure with little or no flow). The pumps are stopped and the standpipe pressure is bled off, pressure is bled through the equalization ports in the control valve. Once pressure is bled off, the control valve is shifted to an "at rest" position. The pumps are started and rate is slowly increased. Again, 1000 p.s.i. pump pressure is not exceeded in order to initiate circulation. If a rate of 30 gpm is achieved without significant pump pressure, the control valve is in the "circulate" position.

Pump speed is increased to a desired flow rate, in one aspect the flow rate is within the minimum and maximum flow rates as specified in the chart below. These rates are based on minimum and maximum pressure drops through the control valve of 200 p.s.i. and 700 p.s.i., respectively. Because of these flow rates, based on properly maintained muds: 1) the valve spring remains fully compressed during circulation; 2) the anchor is not prematurely set; and 3) that the circulation ports in the control valve remain closed throughout the milling process.

FLOW RATE WINDOW FOR GIVEN MUD WEIGHT (clean, thin mud only)

| Mud Weight (ppg) | Minimum Flow Rate (gpm) | Maximum Flow Rate (gpm) |
|---|---|---|
| 9 | 150 | 450 |
| 10 | 140 | 425 |
| 11 | 135 | 405 |
| 12 | 130 | 390 |
| 13 | 125 | 375 |
| 14 | 120 | 360 |
| 15 | 115 | 350 |
| 16 | 110 | 340 |
| 17 | 105 | 330 |
| 18 | 100 | 320 |

For orientation, fluid is circulated as required (see above circulation procedure) to orient a tool face. The pumps are stopped once orientation has been achieved. The control valve shifts to an "at rest" position, with ports closed. If additional circulation and/or orientation is required, circulation is again initiated carefully, per above procedure.

To set an anchor, the pumps are started slowly (5–10 gpm) to shift the control valve to an "anchor set" position. Pumping is continued at a slow rate as the operator watches pressure climb.

When the pressure drop through the control valve reaches 1620 p.s.i. (in one aspect) (in one recommended shear pressure—see chart below for other shear pressures), shear screws holding the anchor spring in place shear, allowing the spring to force the traveling slip into the casing. This event may not be observable at the surface.

ANCHOR SET PRESSURES

| No. of shear screws | Shear value (p.s.i.) |
|---|---|
| 1 | 90 |
| 2 | 600 |
| 3 | 1110 |
| 4 | 1620 |
| 5 | 2130 |
| 6 | 2640 |

Pump pressure is then increased to 2050 p.s.i. (intermediate pressure between 1620 and 2480 p.s.i.) and maintained. The operator slacks off 10,000 pounds on the string to ensure that the anchor has set while pressure is maintained. Then the weight is picked back up. Pressure is increased further. As the pressure increases, the ball seat or plug at the bottom of the auto-fill setting device shears out at 2480 p.s.i. pressure drop through the tool (a recomended shear pressure—see chart below for other shear pressures). A flow rate of up to 20 gpm may be required to accomplish this, because of flow through equalizing ports. Consequently, pump pressure may actually be slightly higher than this preset value, due to minimal pressure losses in the drill string and annulus. A sudden loss in pump pressure and subsequent fluid returns once the ball seat shears will be observable at the

AUTO-FILL SETTING DEVICE SHEAR PRESSURES

| No. of shear screws | Shear value (p.s.i.) |
|---|---|
| 1 | 620 |
| 2 | 1240 |
| 3 | 1860 |
| 4 | 2480 |
| 5 | 3100 |
| 6 | 3720 |

Once the ball set is sheared out, the valve automatically shifts up to the "at rest" position, where it remains until retrieved from the hole, and flow is directed through the bottom of the control valve through the starting mill ports. Then the operator set downs 25,000 pounds weight (recommended shear stud value—others are available) to shear the stud connecting the starting mill to the cave, and milling operations are commenced.

Once a desired window has been established and the whipstock is no longer required, the whipstock is retrieved by latching into a retrieving slot or by screwing a die collar onto outer diameter threads at the top of the concave. If the whipstock body refuses to dislodge, an overpull of 82,500 pounds shears screws holding the concave to the anchor allowing retrieval of the concave while leaving the anchor body available in the hole for subsequent retrieval operations. In one aspect, a 4 inch outer diameter by 9 inch long fishing neck protrudes upward from the anchor body.

As an alternative fill up mechanism for allowing the string to fill with fluid as the system is introduced down into a wellbore, an alternative to the auto-fill assembly of the system of FIG. 6A, a fill sub may be used above or below the system of FIG. 6A. In one aspect a fill sub is used above the valve assembly of the system of FIG. 6A. Alternatively, a fill sub may be used with the system of FIG. 6A. Alternatively a fill sub without a float valve may be used above the valve assembly and a float valve used below, or vice versa.

A fill sub 660 according to the present invention (see FIGS. A–11D) has a top sub 662 with a flow bore 664, a body 662 with a flow bore 665 connected to the top sub 661, a ball valve assembly 670 with a flow bore 671, and a float valve assembly 690 with a flow bore 691. A spacer sleeve 663 in the flow bore 665 surrounds part of the valve assembly 670 and abuts a top end of a body 680.

A spring seat member 666 is movably disposed with a top part in a retainer 668 and a bottom part in a flow bore 673 of the valve assembly 670. The retainer 668 is secured in a top end of a body member 674 whose interior walls define the bore 673.

The body member 674 has a lower seat 675 against which a ball 672 seats to selectively prevent fluid from flowing through a hole 676, into a space in a groove 677, and through a port 678. The body 680 is secured in the bore 665. O-rings 645 seal various interfaces.

Figure 8:
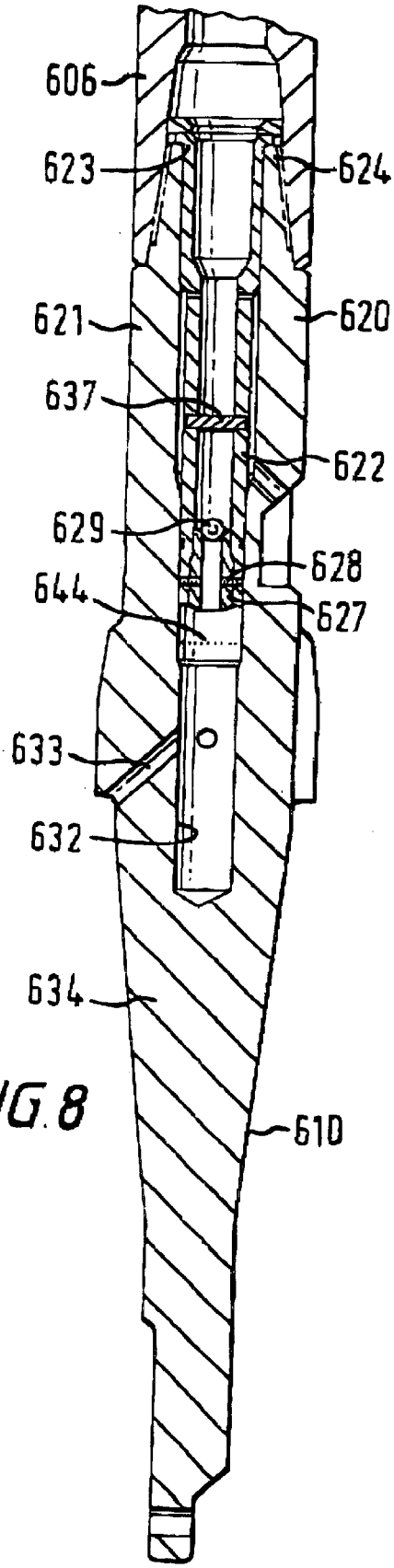
FIG. 8 is an enlarged view of the mill of FIG. 7.

When the fill sub 660 is used, in one aspect, the ball and ball seat may be deleted from the system of FIG. 8 and the plug of FIG. 9B is used instead. When fluid with sufficient pressure enters the port 678, the ball 672 is pushed up away from the seat 675 and up against a ball seat 669 of the spring seat member 666, which in turn is urged against a spring 667, thus opening the port 678, bore 783, and hole 681 to flow for filling the string as it is introduced into a wellbore.

The float valve assembly 690 remains shut while the string is being lowered in the wellbore since a spring loaded flapper 692 connected below a body 693 is spring-loaded up or shut. Fluid flows through a bore 695 of a lower body member 696 extending down from the body 693. An optional vent hole 694 through the flapper 692 vents fluid pressure build-up on the downside (below) the flapper 692 as the system is lowered into a wellbore.

In order to have a charge of clean fluid to activate apparatus below the whipstock 640 (e.g. but not limited to an anchor A, see FIG. 7), a rupture disc is emplaced in the bore of the starting mill 610, e.g. set to rupture by pumping fluid downhole at a pressure of 3,000 pounds. The rupture disc, in one aspect, is placed below the valve assembly and between the fill sub 660 and the starting mill 610. The ball 629 is deleted from the starting mill 610. Thus a charge of clean fluid is releasably captured between the rupture disc and the float valve 690. If the optional vent hole 694 is used, this can relieve pressure build up of the clean fluid charge. In one aspect a rupture disc 644 (shown in dotted line in FIG. 8) is positioned above the ports 633 (FIG. 8) and below the hole 643. Thus contained between the fill sub and mill releasably is a charge of fluid (in one aspect clean fluid free of debris, cuttings, junk etc.) for use in setting an anchor or activate other apparatus. In certain aspects, the tubing 660 contains part of the fluid charge extending down to the anchor or other item or tool and fluid pressure from above pushes the charge down for anchor (or other item) activation. In another aspect a second rupture disc with a burst strength, in one aspect, less than that of the disc 644, is placed in the mill, in the fill sub, or in a lower part 606 of the valve assembly 602 (or in some other tubular bore above the first rupture disc).

In conclusion, therefore, it is seen that the present invention and the embodiments disclosed herein and those covered by the appended claims are well adapted to carry out the objectives and obtain the ends set forth. Certain changes can be made in the described and in the claimed subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112.

What is claimed is:

1. A valve assembly connectable in a string of hollow tubulars in a wellbore extending from a surface of the earth into the earth and for selectively controlling fluid flow through a hollow tubular in the string, said valve assembly comprising:

a hollow body defining an interior space, said hollow body having an inwardly projecting lug and at least one body fluid flow port extending from said interior space to exterior of said hollow body;

an upwardly biased piston assembly movably mounted within said interior space of said hollow body, said piston assembly having a generally vertically extending piston bore adapted to communicate fluid flow from the surface through said valve assembly;

at least one piston fluid flow port extending generally radially outward from said piston bore; and a track defining a branched slot engageable with said lug to direct movement of said piston assembly between a plurality of predetermined positions relative to said hollow body, including at least from a first position wherein said piston fluid flow port and said body fluid flow port are aligned so as to permit fluid flow from therebetween, to at least a second position wherein said piston fluid flow port and said body fluid flow port are substantially misaligned such that fluid flow between said piston fluid flow port and said body fluid flow port is substantially restricted.

2. The valve assembly of claim 1, wherein said piston assembly further includes a sleeve disposed about said piston bore and spaced radially from the inside surface of said hollow body, said sleeve including said track.

3. The valve assembly of claim 1, wherein said piston assembly further includes a piston body defining said bore, said track being disposed about said piston body.

4. The valve assembly of claim 3, wherein said piston assembly further includes a sleeve disposed about said piston body, said sleeve including said track.

5. The valve assembly of claim 1, wherein said branched slot is configured with a plurality of position recesses, each of said position recesses corresponding to one of said plurality of predetermined positions, such that one position recess corresponds to said first predetermined position, and a second position recess corresponds to said second predetermined position.

6. The valve assembly of claim 1, wherein said branched slot is configured such that said piston assembly is movable downward from said first predetermined position to said second predetermined position, to move said piston fluid flow port away from said body fluid flow port and to cease fluid flow between said piston fluid flow port and said body fluid flow port.

7. The valve assembly of claim 6, wherein said piston assembly further includes a circumferential portion vertically and rotatably movable relative to said hollow body and sealingly engageable with the inside surface of said hollow body, such that, when said piston assembly is disposed in said second predetermined position, said circumferential portion sealingly engages the inside surface to block fluid flow between said piston fluid flow port and said body fluid flow port.

8. The valve assembly of claim 1, further comprising a spring assembly engaging said piston assembly to urge said piston assembly upwardly, such that said piston assembly moves against said spring assembly to move from said first predetermined position to said second predetermined position.

9. The valve assembly of claim 1, wherein, when said piston assembly is disposed in said first predetermined position, said piston assembly and said hollow body permit fluid flow from exterior of said hollow body into said piston bore, and, in another predetermined position of said piston assembly, said piston assembly and said hollow body permit fluid flow from said piston bore to exterior of said hollow body.

10. The valve assembly of claim 1, wherein said piston assembly further includes an outlet operable to permit fluid flow from said piston bore into a section of the string connected below said valve assembly, wherein said piston assembly is movable to a third predetermined position to permit fluid flow from the surface through said outlet.

11. The valve assembly of claim 1, wherein said piston assembly is vertically and rotatably movable relative to said hollow body.

12. The valve assembly of claim 1, herein said branched slot is configured with a plurality of position recesses, each of said position recesses corresponding to one of said plurality of predetermined positions, including a first position recess corresponding to said first position of said piston assembly in which said piston assembly and said hollow body are aligned such that, as the string is run into the well bore, fluid in the well bore is permitted into said piston bore, a second position recess corresponding to a circulate position of said piston assembly, wherein said piston assembly and said hollow body are aligned such that fluid pump down from the surface into said piston bore is flowable therefrom to exterior of the hollow body, and third position recess corresponding to a third position of said piston assembly, wherein fluid is flowable through said piston bore past said piston fluid flow port and downward through an opening of said piston assembly below said body fluid flow port.

13. The valve assembly of claim 12, further comprising a spring assembly that abuts a bottom surface of said piston assembly to urge said piston assembly upwardly and thereby releasably maintaining said lug in one of said plurality of position recesses.

14. The valve assembly of claim 1, wherein said piston assembly further includes a generally downward extension body having a top and a bottom, said fluid flow bore extending generally downward through said extension body, a plug releasably secured, by a shearable member, in said bottom of said extension body, and said shearable member being shearable to release said plug in response to fluid pumped from the surface to said valve assembly and such that fluid passes through said piston fluid bore into a portion of the string below said valve assembly.

15. A valve assembly connectable in a string of hollow tubulars in a wellbore extending from a surface of the earth into the earth and for selectively controlling fluid flow through a hollow tubular in the string, said valve assembly comprising:

a generally elongated hollow body defining an interior space, said hollow body having at least one body fluid flow port extending from said interior space to exterior of said hollow body;

a piston assembly movably mounted within said interior space of said hollow body, said piston assembly including an elongated body having a generally vertical piston bore adapted to communicate fluid from the surface through said valve assembly, and at least one piston fluid flow port extending generally radially outward from said piston bore; and a ratchet apparatus including a ratchet track and a lug engageable therewith, that engages said piston body with said hollow body to direct movement of said piston assembly within said interior space between a plurality of predetermined positions relative to said hollow body, said track defining a branched slot having a plurality of position recesses, each of said position recesses corresponding to one of said plurality of predetermined positions, including a first position recess corresponding to a first predetermined position wherein said piston fluid flow port and said body fluid flow port are aligned to permit fluid flow therebetween and a second position recess corresponding to a second predetermined position, said piston assembly being downwardly movable to said second predetermined position to cease fluid flow between said piston fluid flow port and said body fluid flow port.

16. The valve assembly of claim 15, wherein said hollow body includes said lug and said piston assembly includes said ratchet track, wherein said lug projects radially inwardly to engage said ratchet track and said ratchet track is fixedly movable with said elongated body.

17. The valve assembly of claim 16, wherein said piston assembly further includes a sleeve disposed about said elongated body, said sleeve including said ratchet track.

18. The valve assembly of claim 15, wherein said piston assembly includes an extension of said piston body that is movable to open a fluid outlet of said bore, said piston assembly being movable to a third predetermined position wherein said extension is moved to open said outlet to permit fluid flow from said piston bore through said outlet.

19. The valve assembly of claim 15, further comprising a spring assembly engaging said piston assembly to urge said piston assembly upwardly, such that said piston assembly moves downwardly against said spring assembly to move from said first predetermined position to said second predetermined position, said spring assembly being positioned to releasably maintain said lug in one of said plurality of recesses.

20. The valve assembly of claim 15, wherein said position recesses includes said first position recesses which corresponds to said first predetermined position of said piston assembly in which said piston assembly and said hollow body are aligned such that, as the strong is run into the well bore, fluid in the well bore is permitted into said piston bore, and a third position recess corresponding to a third predetermined position of said piston assembly, wherein fluid is flowable from said piston bore to exterior of the hollow body.

21. The valve assembly of claim 15, wherein said piston assembly is vertically and rotatably movable relative to said hollow body between said plurality of predetermined positions.

22. A milling system for milling an opening in a tubular in a tubular string in a wellbore extending down from a surface of the earth, said milling system comprising:

an anchor assembly including a body having an interior space and a slip movably mounted to said body, said anchor assembly having a fluid flow bore therethrough and a piston movably mounted in said interior space and movable by fluid, deliverable by said fluid flow bore, to move said slip relative to said body to set said anchor assembly in the tubular;

a whipstock connected to said anchor assembly;

a mill apparatus releasably connected to said anchor assembly, said mill apparatus including a mill fluid passage disposed in fluid communication with said fluid flow bore of said anchor assembly;

a valve assembly connected at a bottom end thereof to said mill apparatus for selectively controlling fluid flow from the surface to said anchor assembly, said valve assembly including a generally elongated hollow body defining an interior space, said hollow body having at least one body fluid flow port extending from said interior space to exterior of said hollow body; and a piston assembly movably mounted within said interior space of said hollow body, said piston assembly including;

a piston bore extending generally vertically and adapted to communicate fluid flow from the surface through said valve assembly;

an outlet of said piston bore that is adapted to fluidly communicate with said mill fluid passage;

at least one piston fluid flow port extending generally radially outward from said piston bore; and a ratchet track and lug apparatus, including a ratchet track and a lug engageable therewith, that engages said piston assembly with said hollow body to direct movement of said piston assembly within said interior space between a plurality of predetermined positions relative to said hollow body, wherein, in a first predetermined position, said piston fluid flow port is aligned with said body fluid flow port to permit fluid communication therebetween, and in a second predetermined position, said piston fluid flow port and said body are substantially misaligned to restrict fluid flow therebetween.

23. The system of claim 22, wherein said piston assembly includes said ratchet track, and said hollow body includes said lug, said lug projecting radially inward from said hollow body to engage said ratchet track.

24. The system of claim 22, wherein said piston assembly includes a piston body defining said piston bore, said piston assembly further including said ratchet track, said track being fixedly movable with said piston body.

25. The system of claim 24, wherein said piston assembly includes a sleeve fixedly disposed about said piston body, said sleeve including said track, and said hollow body including said lug.

26. The system of claim 22, wherein said piston assembly includes an extension of said piston body that is movable to open said outlet of said piston bore, said piston assembly being movable to a third predetermined position wherein said extension is moved to open said outlet to permit fluid flow from said piston bore to said mill fluid passage.

27. The system of claim 22, wherein said branched slot is configured with a plurality of position recesses, each of said position recesses corresponding to one of said plurality of predetermined positions of said piston assembly, such that a first position recess corresponds to said first predetermined position, and a second position recess corresponds to said second predetermined position.

28. The system of claim 27, wherein said first position recesses corresponds to said first predetermined position of said piston assembly in which said piston assembly and said hollow body are aligned such that, as the string is run into the well bore, fluid in the well bore is permitted into said piston bore, and wherein said position recesses further includes a third position recess corresponding to a third predetermined position of said piston assembly wherein fluid is flowable from said piston bore to said mill fluid passage.

29. The system of claim 27, further comprising a spring assembly engaging said piston assembly to urge said piston assembly upwardly, and to releasably maintain said lug in one of said plurality of position recesses.

30. The system of claim 22, wherein said piston assembly is movable to a third predetermined position to permit fluid flow from the surface through said outlet and to said mill fluid passage.

31. The system of claim wherein 22, wherein said piston assembly is vertically and rotatably movable relative to said hollow body between said plurality of predetermined positions.

32. The system of claim 22, wherein said branched slot is configured with a plurality of position recesses, each of said position recesses corresponding to one of said plurality of predetermined positions, including a first position recess corresponding to said first position of said piston assembly in which said piston assembly and said hollow body are aligned such that, as the string is run into the well bore, fluid in the well bore is permitted into said piston bore, a second position recess corresponding to a circulate position of said piston assembly, wherein said piston assembly and said hollow body are aligned such that fluid pump down from the surface into said piston bore is flowable therefrom to exterior of the hollow body, and a third position recess corresponding to a third position of said piston assembly, wherein fluid is flowable through said piston bore past said piston fluid flow port and downward through said outlet and to said mill passage to set the anchor assembly.

* * * * *